US007380481B2

(12) United States Patent
Barnett et al.

(10) Patent No.: US 7,380,481 B2
(45) Date of Patent: Jun. 3, 2008

(54) PASS THROUGH SOCKET AND RATCHET WRENCH COMBINATION

(76) Inventors: Franklin Earl Barnett, 1407 Colorado Ave., La Junta, CO (US) 81054; Brian Donald Smith, 8863 S. Maplewood Dr., Highlands Ranch, CO (US) 80126

( * ) Notice: Subject to any disclaimer, the term of this patent is extended or adjusted under 35 U.S.C. 154(b) by 0 days.

(21) Appl. No.: 10/490,968

(22) PCT Filed: Sep. 25, 2002

(86) PCT No.: PCT/US02/30377

§ 371 (c)(1),
(2), (4) Date: Mar. 24, 2004

(87) PCT Pub. No.: WO03/026852

PCT Pub. Date: Apr. 3, 2003

(65) Prior Publication Data

US 2004/0244543 A1 Dec. 9, 2004

Related U.S. Application Data

(60) Provisional application No. 60/380,343, filed on May 13, 2002, provisional application No. 60/346,535, filed on Jan. 8, 2002, provisional application No. 60/325,880, filed on Sep. 27, 2001.

(51) Int. Cl.
*B25B 13/46* (2006.01)

(52) U.S. Cl. ..... 81/63; 81/60; 81/61; 81/62; 81/63.1; 81/63.2

(58) Field of Classification Search ..... 81/60, 81/61, 62, 63, 63.1, 63.2
See application file for complete search history.

(56) References Cited

U.S. PATENT DOCUMENTS

| | | | | |
|---|---|---|---|---|
| 2,869,410 | A | 1/1959 | Prichard | |
| 3,869,945 | A | 3/1975 | Zerver | |
| 3,877,328 | A | 4/1975 | Sullivan | |
| 4,328,720 | A * | 5/1982 | Shiel | 81/63 |
| 4,515,044 | A | 5/1985 | Harstad | |
| 4,602,534 | A * | 7/1986 | Moetteli | 81/177.85 |
| 5,203,240 | A | 4/1993 | Sorter | |
| 5,259,278 | A | 11/1993 | Leas | |
| 5,277,088 | A | 1/1994 | Vasichek | |
| 5,295,422 | A | 3/1994 | Chow | |
| 5,365,807 | A | 11/1994 | Darrah | |
| 5,450,773 | A | 9/1995 | Darrah | |
| 5,626,062 | A * | 5/1997 | Colvin | 81/63.2 |
| 5,669,273 | A | 9/1997 | Huang | |

(Continued)

*Primary Examiner*—Joseph J. Hail, III
*Assistant Examiner*—Shantese McDonald

(57) ABSTRACT

A pass through socket (12) and wrench (10) combination is disclosed wherein a first drive member (22*a*, 22*b*) is provided on the socket's exterior surface and a second drive member (24) is provided on the front side of the ratchet wrench's wheel (26) for engaging the socket's first drive member (22*a*, 22*b*) to enable the socket (12) to be driven with the wrench (10). The wrench's wheel (26) defines an axially aligned through hole (30) extending through the wheel (26) for receiving an insertable end of the socket (12) through the front side of the wheel (26). Socket retention means, preferably a snap ring mounted on the front side of the ratchet wheel (26), is also provided.

110 Claims, 9 Drawing Sheets

U.S. PATENT DOCUMENTS 5,901,620 A 5/1999 Arnold
6,006,630 A 12/1999 Vasichet
RE36,797 E 8/2000 Eggert et al.
6,164,166 A * 12/2000 Whiteford ..... 81/63.1
6,260,447 B1 7/2001 Hutt
6,389,931 B1 * 5/2002 Delaney et al. ..... 81/60

* cited by examiner 56
99
26
50
82
74
72
58
64
60
30
24
96
62
72
64
98
22b
68
17
16
34
33
32
22a
68
12

116
117
102
68
22b
100
68
22a 98
50
64
74
32
68
17
16
12
64
60
22a

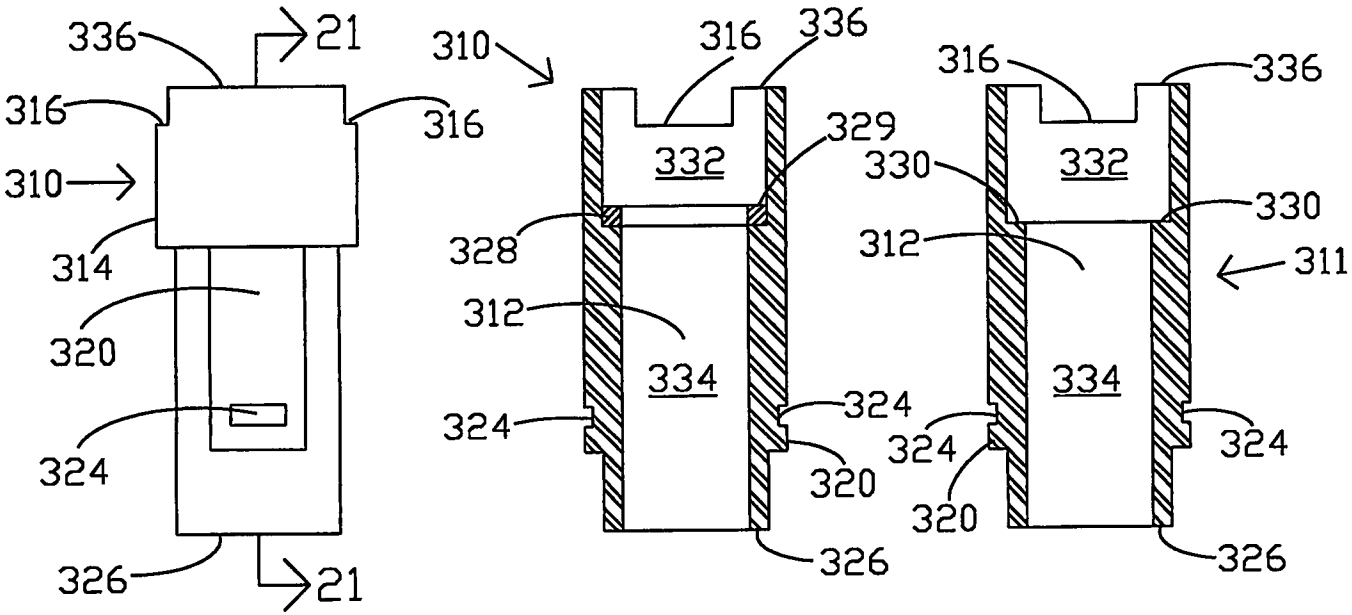
FIG 19
FIG 21
FIG 23
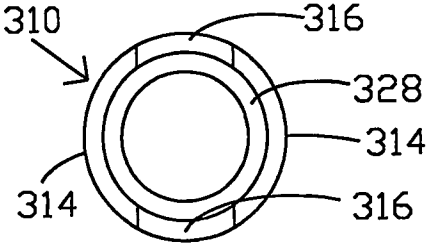
FIG 22
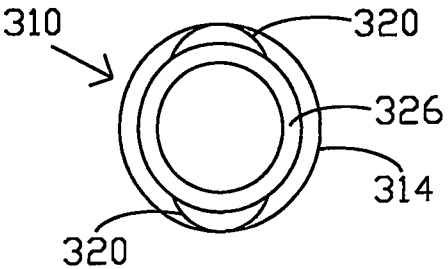
FIG 20

PASS THROUGH SOCKET AND RATCHET WRENCH COMBINATION

CROSS-REFERENCE TO RELATED APPLICATIONS

This application is a national stage filing under 35 U.S.C. 371 of PCT application No. PCT/US02/30377 filed Sep. 25, 2002 which claims the benefit under 35 U.S.C. 119(e) of U.S. provisional patent applications Ser. Nos. 60/380,343 filed May 13, 2002; 60/346,535 filed Jan. 8, 2002 and 60/325,880 filed Sep. 27, 2001, the disclosures of which are incorporated by reference herein in their entireties.

TECHNICAL FIELD OF THE INVENTION

The invention relates generally to socket ratchet wrenches, and more particularly to socket ratchet wrenches and sockets of the type for receiving and allowing an externally threaded member to pass through the socket and wrench as a fastener threaded on the threaded member is torqued or driven with the socket and ratchet wrench.

BACKGROUND OF THE INVENTION

Over the years various ratchet wrenches and sockets for use therewith have been developed for allowing an externally threaded member to pass through the socket and wrench as a fastener threaded on the threaded member is driven with the socket and ratchet wrench. By allowing the threaded member to pass through the socket and wrench, these wrenches eliminate the need for deep well sockets which are expensive and break more easily than shallow sockets. These wrenches are commonly referred to as "pass through" wrenches and two known wrenches of this type which are commercially available today are the Armstrong Eliminator wrench which is available from the Danaher Tool Group of Lancaster, Pa. and the O-Ratchet wrench which is available from Summit Tools of Denton, Tex. A wrench similar to the Eliminator wrench is generally described in U.S. Pat. No. 5,857,390 to Whiteford while a wrench similar to the O-Ratchet wrench is described in U.S. Pat. No. 4,602,534.

While both of these wrenches work with varying degrees of success neither has been particularly successful in the marketplace because neither offers all the advantages of conventional sockets and ratchet wrenches which use the conventional square male drive to connect the socket to the wrench and drive the socket. The Eliminator and O-Ratchet wrenches seem to have particular difficulty in holding the socket on the wrench. They are also more complicated and more expensive to manufacture than conventional wrenches and sockets. Other "pass through" type wrenches found in a search of the patent literature include U.S. Pat. No. 5,626,062 to Colvin and U.S. Pat. No. 4,328,720 to Shiel as well as our own previously developed "pass through" ratchet wrench which is described in International application No. WO 98/49455.

SUMMARY OF THE INVENTION

The present invention addresses the deficiencies of the foregoing "pass through" type sockets and ratchet wrenches by providing a novel socket and ratchet wrench combination which utilizes an insertable socket and a toothed or detented wheel/gear in a fashion similar to some other pass through type wrenches but which transmits force to the socket through the front side of the wheel/gear as opposed to the wheel's center as described in more detail herein. This type of force transmission is sometimes referred to herein as being offset or "out of the hole" and it is advantageous in a pass through wrench because it enables the provision of a larger diameter hole through the wrench's wheel/gear which allows the wheel/gear to pass larger diameter bolts, thereby increasing the through hole capacity of the wrench/socket combination.

In general, the novel socket of the socket and wrench combination of the present invention has a fastener receiving end defining a drive socket cavity for engagingly receiving a fastener to be driven and an oppositely facing insertable end defining a through hole passageway in communication with said drive socket cavity for receiving and allowing an externally threaded member to pass through the socket as the fastener is driven on the threaded member with the novel ratchet wrench of the present invention. The socket is also provided with a first drive member on its exterior surface which is preferably provided in the form of a lug that extends partially around the circumference of the socket's mid-section and which enables the socket to be driven by the wrench of the present invention as described in detail below.

The unique ratchet wrench of the present invention includes a ratchet wheel/gear having a front side and a back side with a detented/toothed rim located between the wheel/gear's front side and back side. The wheel/gear defines a through hole which is axially aligned about the rotational axis of the wheel/gear for receiving the insertable end of the wrench socket through the front side of the wheel/gear. The wheel/gear's through hole extends through the ratchet wheel/gear from the wheel/gear's front side to and through its back side to allow an externally threaded member to pass through the socket's through hole passageway as a fastener is driven on the threaded member with said ratchet wrench and socket. The ratchet wheel/gear further defines a second drive member, preferably a notch, in the wheel/gear's front side for engaging the socket's first drive member, preferably the aforementioned lug, to enable the socket to be driven with the wrench.

The ratchet wrench also includes a pawl and a wrench body which receives the ratchet wheel/gear for rotation relative to each other. The wrench body also receives the pawl for (1) engaging the detented/toothed rim of the ratchet wheel/gear when the wrench body is rotated in a first direction relative to the ratchet wheel/gear to prevent the wrench body and the ratchet wheel/gear from rotating relative to each other and for (2) releasing the detented/toothed rim of the wheel/gear to permit the wrench body and the ratchet wheel/gear to rotate relative to each other when the wrench body is rotated in a second direction opposite the first direction.

In addition, the wheel/gears's through hole and the insertable end of the socket are preferably cylindrical since a cylindrical shape enables the inside diameter of the socket's through hole passageway to be as large as possible which means the socket and wrench of the present invention can pass bolts having larger diameter threaded shafts than wrenches having non-cylindrical insertable ends such as those of the aforementioned Colvin and Shiel patents which have hex-shaped insertable ends.

Also, in all preferred embodiments, the insertable end of the socket is sized to fit closely in the through hole of the wheel/gear. This limits wobbling of the socket when it is inserted in the wrench.

In addition, in the preferred embodiment which utilizes a lug and notch as discussed above, the notch opens into the through hole on the front side of the wheel/gear and indeed must do so to receive the drive lug of the socket.

Finally, the present invention includes a socket retention means, preferably a snap ring or a permanent magnet, for releasably holding or retaining the socket in the wrench after it has been fully inserted in the through hole of the wrench's wheel/gear, i.e. when the socket's first drive member, preferably the above mentioned lug, is engaging the wheel/gear's second drive member which is preferably the notch as mentioned above. As part of the socket retention system, the socket is preferably provided with a predetermined length so that when it is fully inserted into the through hole of the wrench, its bottom edge (i.e. the bottom edge of the insertable end of the socket) extends beyond the back side of the wheel/gear or the exterior surface of the wrench head. This enables the socket's bottom edge to be easily pushed by a user of the wrench, preferably pressed against with one's thumb, to release of the socket from its retention means, preferably the aforementioned snap ring or magnet, thereby facilitating the socket's easy removal from the wheel/gear.

One significant advantage of this socket retention system is that it makes socket removal so easy that the system can be designed to require the application of as much as 8 lbs of force or more for socket removal. This is a lot of force for socket removal which typically only requires the application of about 4 pounds of force. However, 8 pounds or more of force for socket removal is desirable since it virtually eliminates the need for any type of system for locking the socket to the wrench. Locking systems are undesirable since they add complexity, cost and take up valuable space in the wrench head.

The foregoing socket retention system of the present invention is preferably used in conjunction with the "out of the hole" type drive system of the present invention as described above. However, it may be utilized on more conventional hex drive systems as well as the spline drive system of the Eliminator ratchet wrench described above and its use on such other systems is considered to be within the scope of the present invention.

In addition to the foregoing socket and wrench combination, the present invention provides novel sockets, a novel socket set, socket extensions and methods of inserting and removing a socket from the wrench.

BRIEF DESCRIPTION OF THE DRAWINGS

The invention will be more readily understood by reference to the accompanying drawings wherein like reference numerals indicate like elements, and wherein reference numerals sharing the same last two digits of the embodiments of FIGS. 1 through 12 identify similar corresponding elements therein, and in which:

FIG. 19 is a side elevational view showing the extension of FIG. 13 in isolation.

FIG. 20 is a bottom plan view of the extension shown in FIG. 19.

FIG. 21 is a cross sectional view taken along lines 21-21 of FIG. 19.

FIG. 22 is a top plan view of the extension shown in FIG. 19.

FIG. 23 is a cross sectional view similar to that of FIG. 21 showing the extension as it would appear without its ring magnet mounted on the ledge surface of the extension.

DETAILED DESCRIPTION OF PREFERRED EMBODIMENTS

Figure 1:
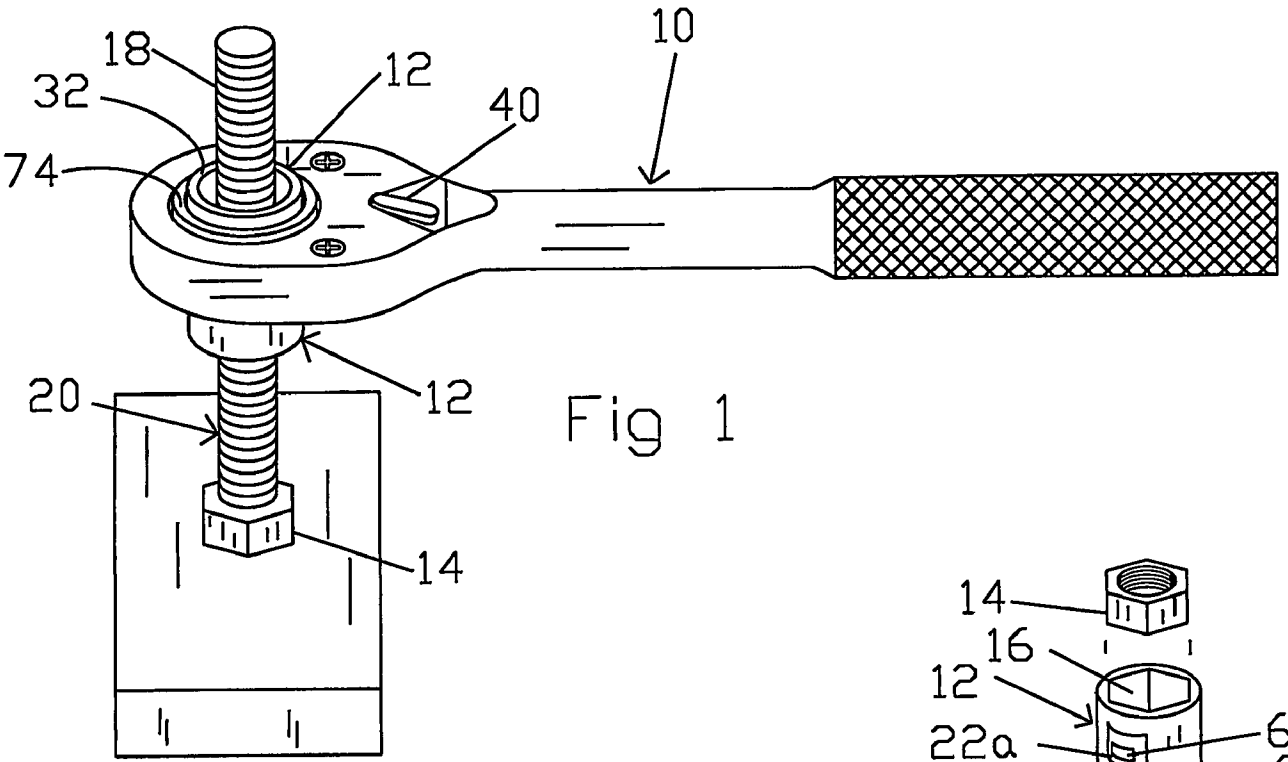
FIG. 1 is a perspective view of a socket and ratchet wrench combination of the present invention showing the threaded shaft of a fastener being passed through the head of the combination so that the combination can be lowered to reach and drive the nut located on the lower end of the threaded shaft.
Figure 2:
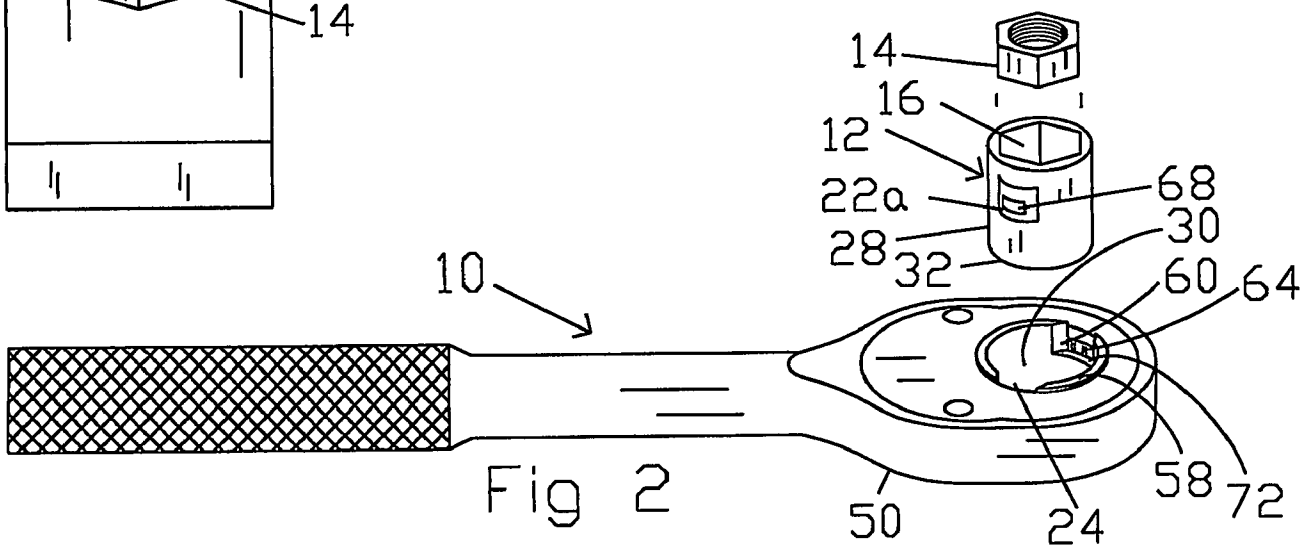
FIG. 2 is a partially exploded perspective view of the socket and ratchet wrench combination of FIG. 1 showing an exploded view of the nut, socket and wrench to illustrate the insertability of the socket in the wrench.
Figure 3:
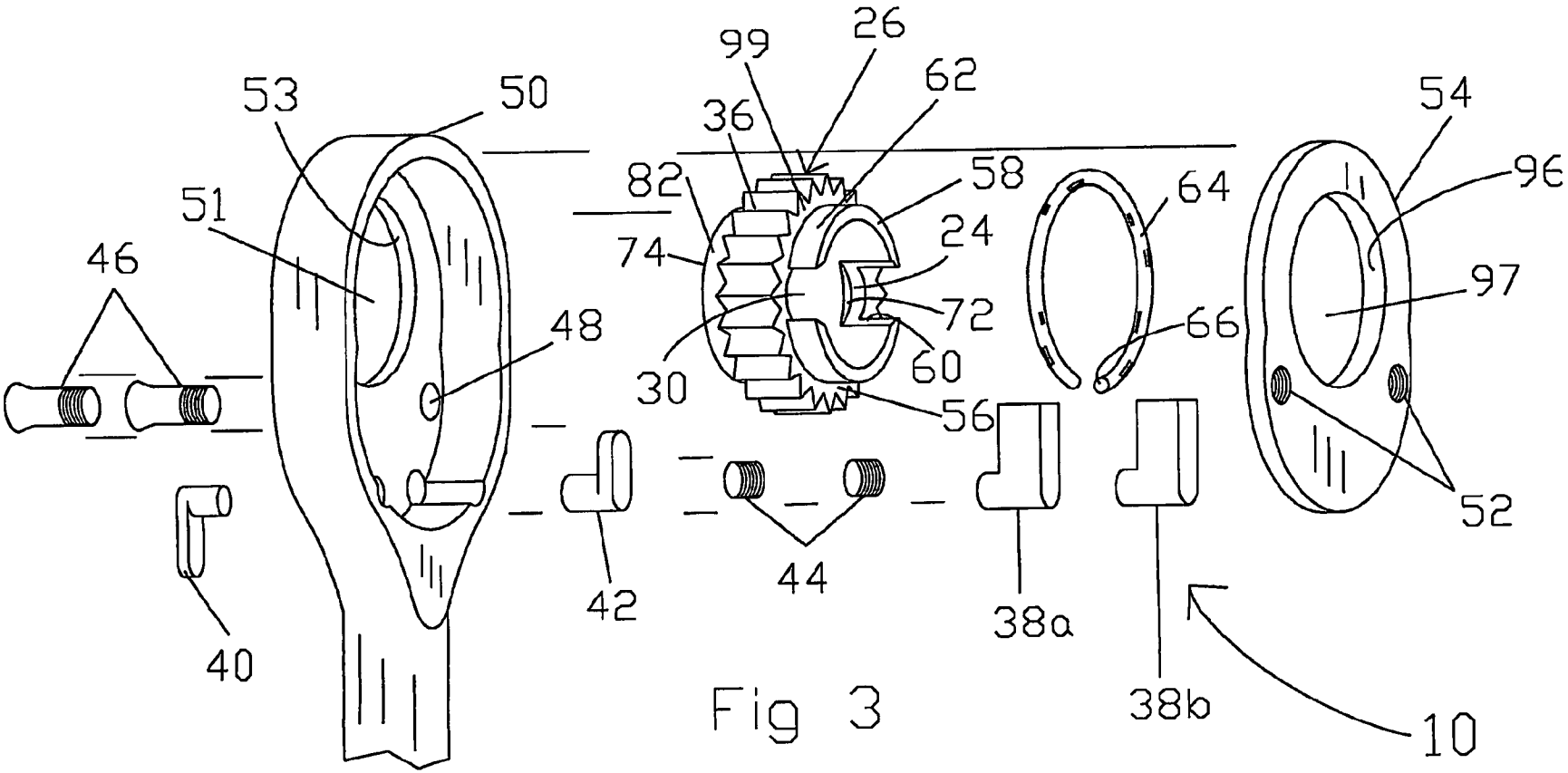
FIG. 3 is an exploded perspective view of the wrench of FIG. 1 showing the components of the wrench.
Figure 4:
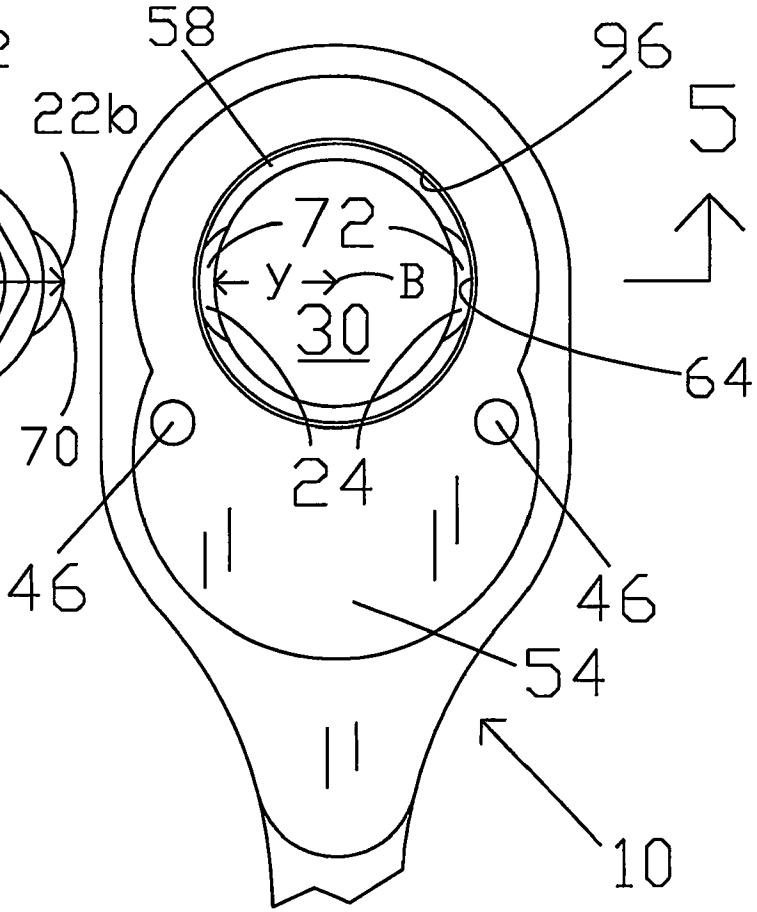
FIG. 4 is a top plan view showing separate top plan views of the wrench and socket of FIG. 1.
Figures 5, 6, 7:
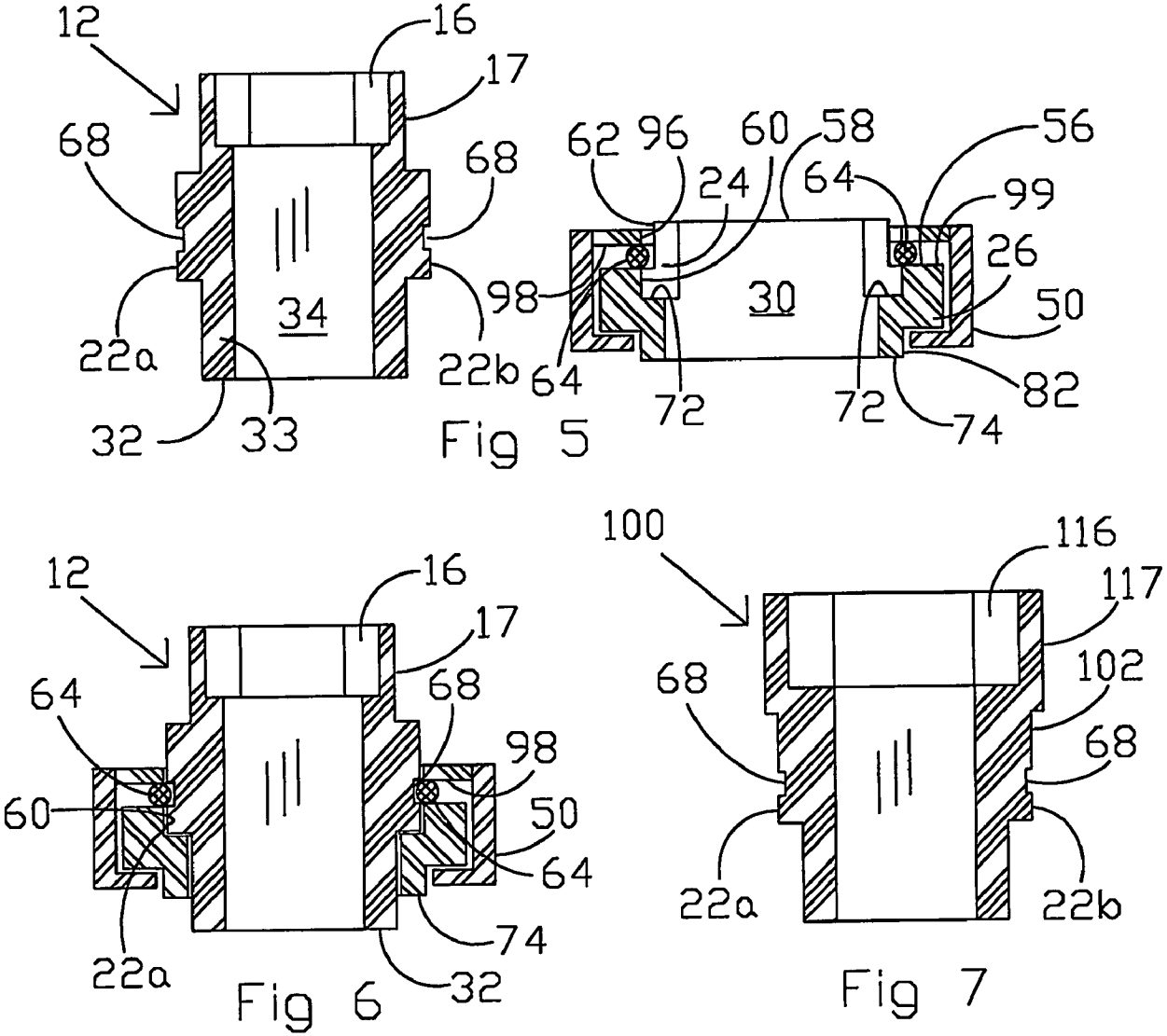
FIG. 5 is a cross sectional view taken along lines 5-5 of FIG. 4.
FIG. 6 is a cross sectional view similar to that of FIG. 5 but showing only a single view with the socket inserted into the wrench.
FIG. 7 is a cross sectional view of another socket of the present invention which is similar to that of the socket illustrated in FIG. 5.

FIGS. 1 through 6 illustrate a novel socket ratchet wrench 10 and socket 12 of the present invention. As shown in FIG. 1, wrench 10 and socket 12 are being used to drive a nut 14 received in the drive socket cavity 16 of the fastener receiving end 17 of the socket on the threaded shaft 18 of a bolt 20. As shown in FIGS. 2 and 4, socket 12 is provided with a pair of drive members or lugs 22*a, b* on its exterior surface and when the socket is inserted in the wrench as shown in FIGS. 1 and 6, lugs 22*a, b* are received in a pair of drive member receiving sections or notches 24 which are defined by the wheel or ratchet gear 26 of the ratchet wrench. The drive lugs and notches are sized so that the lugs are easily received in the notches but not loosely received. The drive lugs are also sized (and shaped) so as to be capable of transmitting the drive forces from the wrench to the nut which are generated by a user of wrench when it is used to drive or torque nut 14 onto a conventional fastener such as threaded bolt 20 shown in FIG. 1.

As mentioned, socket 12 is insertable in wrench 10 and that portion of the socket which is inserted in wrench 10 is referred to herein and identified in the drawings as insertable end 28 of the socket which as shown and as described in more detail below is inserted into a cut-out or through hole 30 extending through the wheel of the wrench. The insertable end of socket 12 as best shown in FIG. 6 extends from an area slightly above the mid-section (not numbered) of lugs 22*a, b* to the bottom edge 32 of the socket. As also shown, the lugs are located on the mid-section (not numbered) of socket 12. Therefore, it will be appreciated that approximately one half of the length of the socket is inserted (or insertable) into the through hole 30 of the wrench's wheel. In addition and as best shown in FIG. 6, the outside diameter of the cylindrical portion of insertable end 28 of the wrench is sized to fit closely but not tightly in through hole 30 of the wheel. This enables the socket to be easily inserted into though hole 30 and the close fitting of the socket in the hole serves to prevent or limit wobbling of the socket in the hole which is a problem in some other through hole wrenches.

It will also be appreciated that the insertable end 28 of socket 12 defines a through hole passageway 34 which is axially aligned about the socket's rotational axis A as shown in FIG. 4 and, as shown in FIG. 5, in communication with the socket's drive socket cavity 16. In accordance with an important aspect of the present invention, passageway 34 is provided with a diameter which is large enough to pass the threaded shaft 18 of bolt 20 through socket 12 as such is shown in FIG. 1. This enables one using the wrench and socket to be able to reach and drive nut 14 no matter how long shaft 18 is.

Turning now to FIG. 3, it will be appreciated that wheel 26 is similar to a conventional ratchet gear in that it has a plurality of detents or teeth 36 on its rim (not numbered) which are engaged by one of the conventional pawls 38*a*, 38*b* to drive the wheel. Pawl 38*a* as those skilled in the art are aware drives the ratchet wheel in one direction while pawl 38*b* drives the wheel in the opposite direction and will do so when the direction of the wheel's direction of rotation is reversed which is caused by flipping the wrench's reversing switch 40 which is also conventional and found in many ratchet wrenches such as those sold under the brand name Urrea by the Urrea Professional Tools, Inc. of San Antonio, Tex. and the brand name Proto sold by Stanley-Proto Industrial Tools of Covington, Ga. A description of how a ratchet works in a ratchet wrench is also described in our earlier patents, U.S. Pat. Nos. 6,142,277 and 5,970,825 which are hereby incorporated by reference.

As is also conventional and found in the above mentioned wrenches, switch 40 includes a piece 42 which slidably receives switch 40 and which presses against either pawl 38*a* or 38*b* depending upon which position switch 40 is in. Pawls 38 are also spring loaded with conventional springs 44 as is also known to those skilled in the art and found in the aforementioned wrenches. Finally and as is also conventional, wrench 10 includes a pair of screws 46 which are inserted through bores 48 of the wrench's body 50 and which thread into threaded bores 52 of wrench's cap 54 to hold the aforementioned components of the wrench together.

Figure 3A:
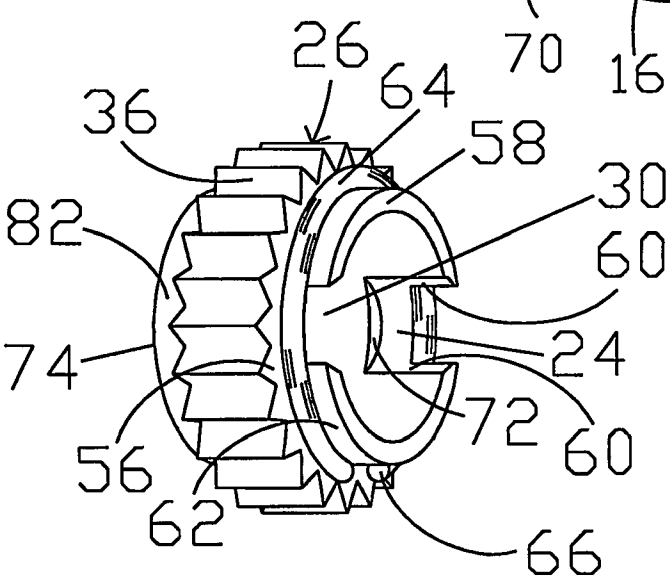
FIG. 3*a* is a perspective view showing the position of the snap ring of FIG. 3 when it is mounted on the wheel/gear of FIG. 3.

Returning to wheel or gear 26, as shown in FIGS. 3, 3*a* and 5 wheel 26 differs from conventional wheels in that it defines previously mentioned cylindrical inner cutout or through hole 30 which extends through the wheel from its front side 56 to and through its back side 74. In addition, as shown in FIG. 4, through hole 30 is positioned in the wheel so that it is axially aligned about the wheel's rotational axis B.

Wheel 26 also includes a ring-like section or collar 58 on the front side 56 of the wheel. Collar 58 serves as an axle for the wheel in that it provides an axle like member for the wheel which rotates within hole 97 defined by the sidewall 96 of the wrench's cap 54. Wheel 26 also has an integral cylindrical rear axle 75 on its back side 74 which similar to collar 58 provides an axle like member for the wheel which rotates within hole 51 defined by the sidewall 53 of the wrench body 50.

Returning to collar 58, it will be appreciated that in addition to serving as the wheel's axle, collar 58 also defines the entrance of through hole 30 as well as that of aforementioned drive notches 24 which open into through hole 30 so that they can receive lugs 22*a, b* when the socket is inserted into the through hole. Collar 58 is preferably integral with the wheel but offset in the sense that it is located to the side of teeth 36 or as discussed in the claims appended hereto along a different axial segment of the wheel's axis of rotation than that in which teeth 36 are located or the force receiving section of the wheel is located. Generally, the force receiving section of the wheel and the teeth would be the same. However, they could be slightly different and the teeth could cover a larger axial segment of the wheel than the force receiving section of the wheel which, as defined herein only includes that section of the teeth or wheel which actually makes direct engaging or driving contact with the pawls.

Similarly, the term "force transmitting section" is sometimes used herein, particularly in the claims appended hereto and as used herein it includes those sections or areas of notches 24 such as sidewalls or edges 60 (See FIGS. 3, 3*a* and 6) that actually make direct engaging or driving contact with the socket's lugs. In wrench 10, notches 24 extend into the toothed section or teeth 36 of the wheel. Accordingly, the force transmitting section extends along edges or sidewalls 60 of each notch from the bottom surface 72 of the notch located in the toothed section of the wheel to the entrance of the notch in the collar 58 of the wheel.

The term "offset" is also sometimes used herein in connection with the location of the notches or force transmitting section and as so used it refers to the fact that while the notches extend into the wheel through its front side, they are nonetheless located on one side, the front side, of the wheel, specifically to the side of the an imaginary plane (not shown) passing through the center of the force receiving section (or teeth) of the wheel which is transverse to the axis of the wheel.

The offset positioning of the notches or force transmitting section of wheel 26 is advantageous in a pass through wrench (also sometimes referred to herein as a through hole wrench) because it facilitates driving of the socket outside of hole 30, i.e. not in hole 30 of the wheel, as is the case with the through hole wrench disclosed in U.S. Pat. No. 5,626,062 to Colvin. It is desirable in a through hole wrench to be able to drive out of the hole because it enables the wall 33 (see FIG. 5) of the insertable end 28 of the socket to be made thinner which in turn enables the diameter of the socket's through hole passageway 34 to be increased. A large diameter through hole is desirable because it will pass the threaded shafts of large bolts and other fasteners, thereby increasing the "through hole" capacity of the wrench. For example, the O-Ratchet wrench made by Summit Tools is a through hole wrench having an external hex shaped drive which is equivalent to a ⅜ inch drive ratchet wrench. A conventional ⅜ inch drive wrench is typically used to drive sockets ranging from ⅜ of an inch to ¾ of an inch. Therefore, a true ⅜ inch drive "through hole" wrench should be capable of passing the threaded shafts of bolts driven with sockets ranging from ⅜ of an inch to ¾ of an inch. The O-Ratchet wrench, however, is not capable of passing the threaded shafts of bolts driven with ⅝ inch sockets or higher. Therefore, the O-Ratchet wrench is not truly "through hole".

It has been determined and it will be appreciated that in order to drive "out of the hole" as discussed above the maximum radius of hole 30 of the wheel should and would normally be less than the maximum distance the lugs 22 extend from the socket's axis of rotation. The radius of hole 30 is identified in FIG. 4 by the letter Y and the maximum distance the lugs extend from the socket's axis of rotation is identified in FIG. 4 by the letter X. Therefore, with an "out of the hole drive" Y would normally be less than X.

Returning now to notches 24 and lugs 22, as best shown in FIG. 4 sidewalls or edges 60 of notches 24 and outer surfaces 70 of lugs 22*a, b* are complementarily shaped as well as curved (i.e. arcuately shaped). This curving and complementarily shaping of notch edges 60 and lug surfaces 70 spreads out the forces being transmitted from the notches to the lugs over a wide area and as such serves to prevent breakage of the lugs and wheel areas defining the notches which could occur during use of the wrench to drive or torque a fastener such as nut 14.

Turning now to the means for holding or retaining socket 12 in wheel 26, as best shown in FIGS. 3, 3*a* and 5, collar 58 has an outer cylindrical surface 62 for receiving a snap ring 64 having a round cross-section (not numbered) and split 66. As shown in FIG. 6, snap ring 64 retains or holds socket 12 in the wheel by holding or receiving the socket's lugs 22*a* and 22*b*, each of which is provided with a groove 68 (see FIG. 5) which receives the snap ring when the socket is inserted in the through hole 30 of the wheel/gear. Snap ring 64 is capable of holding the lugs because its inside diameter is slightly less than the maximum distance between the outer surfaces 70 of lugs 22*a, b*. As will be appreciated from FIG. 4, the maximum distance between the outer surfaces 70 of lugs 22*a, b* is twice X, i.e. 2×.

The snap ring is capable of receiving the socket and its lugs 22*a, b* even through its inside diameter is less than the distance of 2× between the lugs because split 66 of the snap ring allows the snap ring to expand when the socket's lugs 22*a, b* are pushed into the ring as the socket is inserted into hole 30 of the wheel. After insertion, the snap ring holds the socket in hole 30 by its lug 22*a, b* because it elastically contracts and attempts to return to its original diameter as soon as the snap ring is received in the lugs' grooves 68. The snap ring elastically contracts, actually attempts to snap back to its original diameter, and thereby snappingly receives the socket because the snap ring is preferably made from a spring steel which provides it with the discussed elasticity.

Finally and as will be appreciated from FIG. 6, the socket is prevented from being pushed all the way through hole 30 because its lugs 22*a, b* impact up against bottom surfaces 72 of notches 24 immediately after they are pushed into the snap ring. Accordingly, when the lugs' grooves 68 receive the snap ring the socket will be securely held by its lugs 22*a, b* in hole 30 between the snap ring and the bottom surfaces 72 of the notches 24 as such is shown in FIG. 6. When in this position, the lugs 22 are considered to be engagingly received in notches 24 and in position for driving the socket with the wrench.

FIG. 6 also illustrates that socket 12 is provided with a length (as measured along its rotational axis A shown in FIG. 4) which causes its bottom edge 32 to project a short distance outwardly or beyond the back side 74 of the wheel when the socket is engagingly received in hole 30 of the wheel, i.e. with lugs 22*a, b* held by the snap ring. This length and positioning of the socket enables easy removal of the socket from the wrench by simply pushing against the socket's bottom edge 32 with ones thumb. This pushing force causes the lugs to expand the snap ring and thereby release the socket. Indeed, in most cases when the bottom edge 32 of the socket is pushed the elastic springing action of the snap ring actually pops the socket out of the its held position, thereby snappingly releasing the socket as the term is sometimes used herein and in the claims appended hereto. This popping or snappingly release action occurs just as the lugs are being pushed out of the snap ring at which point the elastic springing action of the snap ring takes over and pushes against the lugs. As mentioned, if the springing action of the snap ring is strong enough the snap ring will actually pop the socket out of its held or engaging position as it pushes against the socket's lugs.

It has been discovered that the pushing of the two lugs into the snap ring takes much less force than pushing a cylindrical member such as the socket disclosed in Colvin in which a cylindrical end portion of the having an annular groove is pushed through the snap ring until the ring seats in the groove. The need for less force for insertion of the socket of the present invention is believed to be attributable to the fact that each lug of socket 12 extends in it elongate direction only about 45 degrees around the periphery or circumference of the socket. The fact that the lugs are positioned on opposite sides of the socket, i.e. 180 degrees from each other, may also facilitate insertion and removal as well. In any event, this sizing and positioning of the lugs is believed to cause the snap ring to actually contract in the area located halfway between the lugs even though the snap ring expands in the in the area where the lugs enter the ring.

In contrast, when the aforementioned socket of Colvin is pushed into its snap or retaining ring every other sixty degree section of the end portion of the socket must be pushed through the snap ring. Since this requires expansion of almost all 360 degrees of the snap ring, i.e. the entire circumference of the snap ring, it is clear that it would take much more force to insert a Colvin socket than the lug type sockets of wrench 10 if the snap rings employed in the two systems were of the same thickness or gauge. Therefore, a system such as Colvin's must use thin snap rings since thick snap rings such as those preferably employed in wrench 10 would be nearly impossible for an individual to expand if used in a Colvin style wrench.

While this may not at first glance appear to present a problem, thinner snap rings in actuality lack several advantages possessed by thicker snap rings. One, thinner snap rings do not have the springing or snapping action of thicker snap rings and therefore will not pop the socket out of the wrench's wheel or head as such is discussed above in connection with the thicker snap rings of wrench 10. Two, thinner snap rings are more likely to break or wear out than thicker snap rings. Three, thinner snap rings are more likely to be pushed or moved out of their operative position and therefore would require more maintenance. Four, sockets held by thin snap rings are believed to be much more likely to fall out of the wrench head than those held by thicker stronger snap rings. In the preferred embodiment of the present invention wherein the snap ring has an inside diameter of about one inch, the diameter of the ring of the snap ring is preferably greater than about 0.050 inches and optimally about 0.085 inches.

In addition, ease of socket insertion and removal is believed to be facilitated by the internal mounting of the snap ring 64 on the collar's outer cylindrical surface 62. Internal mounting, i.e. mounting of the snap ring on its inside surface, is believed to facilitate insertion and removal because the ring is free to expand outwardly when the socket's lugs are pushed into the ring. In contrast, all known wrenches using snap or retainer-like rings to hold the socket in the wrench mount the ring externally, i.e. on its outside surface, (usually in a groove in the wall of a hole such as hole 30) which may restrain, limit or even prevent outward expansion of the ring, thereby making it more difficult and require more force to insert and remove the socket. While it may appear from the drawings that snap ring 66 is mounted in the sidewall 96 of cap 54 defining hole 97 of the cap, it is actually mounted under cap 54 between the cap's underside surface 98 and surface 99 of the front side 56 of the wheel (See FIG. 5). As such, the snap ring is held in place and prevented from sliding on the collar's cylindrical surface 62 by cap 54.

In view of the foregoing, it will be appreciated that wrench 10 and socket 12 are not only "through hole", (i.e. capable of passing the threaded shaft 18 of bolt 20 onto which nut 14 is being threaded as such is shown in FIG. 1) but also extremely easy to use by virtue of the fact that to insert the socket in wrench 10 one merely has to align the lugs with the notches and then push the socket into through hole 30 until the snap ring snaps into, i.e. is received in, the lugs' grooves. If the snap ring is strong enough, i.e. has enough elastic springing action as discussed above, the socket will snap into its engaged position between the snap ring and the bottom of the notch when the snap ring snaps into, i.e. is received in, the lugs' grooves. The snapping action is desirable because it makes it easy for the user of the wrench to know when the socket is properly inserted into the wrench.

To remove the socket from the wrench, one merely pushes against the bottom edge 32 of the socket (which as mentioned above projects a short distance beyond the back side 74 of the wheel) until the socket's lugs snap out of the snap ring, i.e. the snap ring snaps out of or pops out of the lugs' grooves 68. Again, if the snap ring is strong enough, i.e. has enough elastic springing action, the socket will actually snap or pop out of the hole or at least pop out of its engaged position in which the lugs are located between the snap ring and the bottom of the notch. At this point, the socket is released from the snap ring and if the socket is still in the hole it can be simply grabbed and pulled out of the hole or the wrench can be turned over to allow gravity to cause the socket to fall out of the hole.

While it is not exactly clear what positioning and sizing of the lugs provides the aforementioned snapping or popping action, it is believed that if only one lug or drive projection is provided on socket 12 it should extend less than about 180 degrees around the circumference of the socket. If two lugs or drive projections are used as shown in the drawings each lug should extend less than 90 degrees around the circumference of said socket and preferably no more than about 60 degrees. Forty five degrees as shown in the drawings (see included angle C of FIG. 4) is believed to be ideal but lugs extending as little as 15 degrees or less around the circumference of the socket may also work if the lugs are capable of withstanding the forces they transmit without breaking or otherwise failing.

FIG. 7 illustrates a socket 100 which is similar to socket 12 in that it has identical lugs 22*a, b* with grooves 68 and an insertable end 28 for inserting the socket in wrench 10. Socket 100, however, differs from socket 12 in that it has a larger fastener receiving end 117 than end 17 of socket 12 which in turn defines a larger drive socket cavity 116 than cavity 16 of socket 12 so that socket 100 can drive a nut which is larger than nut 14 of FIG. 1. FIG. 7 also illustrates that the upper portion 102 (not numbered in the FIGS. 1-6) of lugs 22*a, b* is integral with the larger fastener receiving end 117 of socket 100. By making the lugs' upper portions 102 integral with the socket's end 117 socket 100 should be stronger and able to withstand more force.

FIGS. 8-12 illustrate another ratchet wrench 210 and socket 212 combination of the present invention which is similar to that of FIGS. 1-6 but which uses a permanent magnet 264 instead of a snap ring to hold the socket in the wrench. Components or parts thereof which are identical to those of FIGS. 1-6 are identified by the same reference numerals in both embodiments. Components or parts thereof performing similar functions to those of FIGS. 1-6 are identified with different reference numerals. However, the last two digits of such numerals are the same in both embodiments to indicate the fact that while these components are different in some way they perform similar functions.

Figure 12:
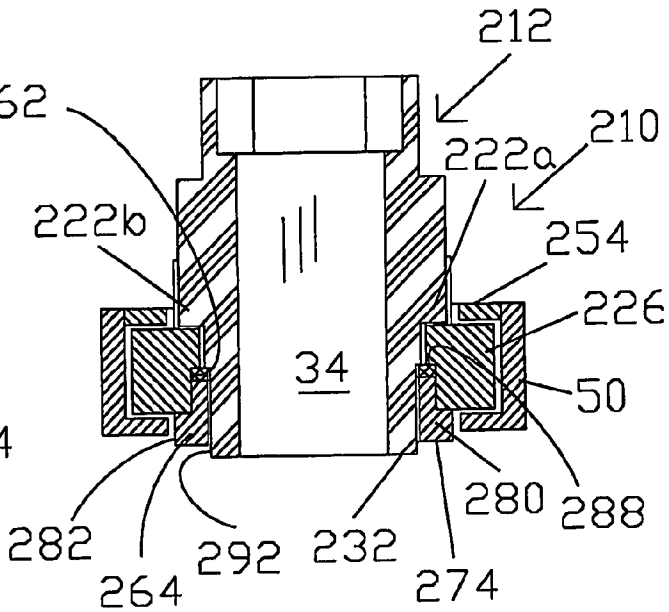
FIG. 12 is a cross sectional view similar to that of FIG. 11 but showing only a single view with the socket inserted into the wrench.
Figure 11:
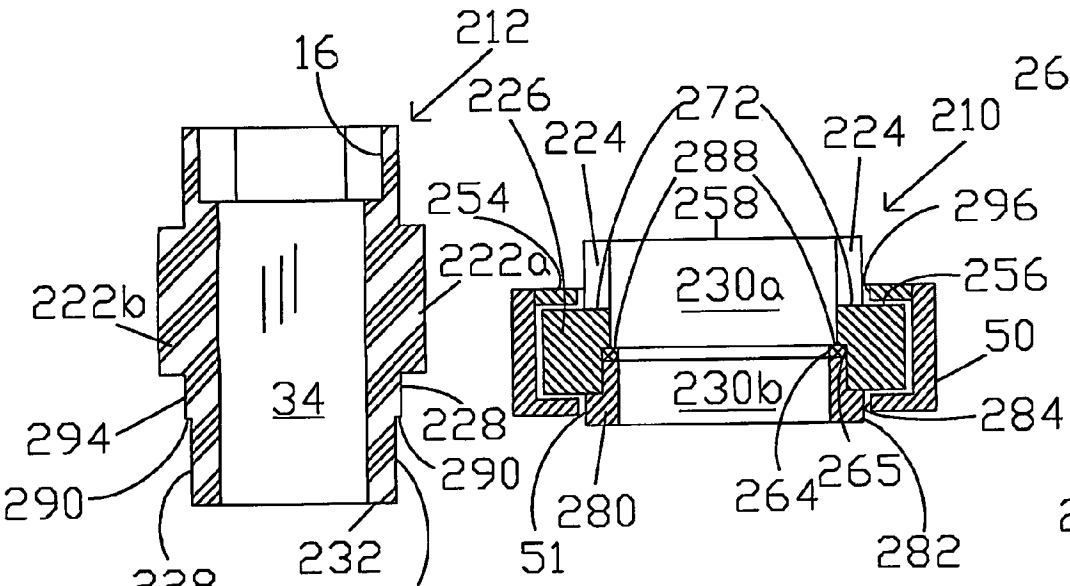
FIG. 11 is a cross sectional view taken along lines 11-11 of FIG. 10.

Turning now to wheel 226, it will be appreciated that wheel 226 is similar to wheel 26. However, the notches 224 do not penetrate into the toothed section of the wheel as notches 24 do in wheel 26. As shown, notches 224 are located in their entirety in collar 58 of the wheel. In addition, since this embodiment utilizes a magnet instead of a snap ring to hold the socket in the wrench, the wheel 226 of this embodiment defines an axial cutout 265 in the through hole of the wheel which receives magnet 264. Cutout 265 also receives an axial plug 280 which abuts up against the bottom surface (not numbered) of magnet 264 as shown in FIGS. 11 and 12 and which protects the bottom surface of the magnet. Plug 280 is considered to be part of the wheel or wheel/gear as the term is used in the claims appended hereto.

As also shown, plug 280 has a flanged end 282 which is sized to closely but not tightly fit within the hole 51 of the wrench body. This insures that the wheel will rotate uniformly and smoothly in the hole 51 of the wrench body 50. Plug 280 may be threaded into cutout 265 or it may be sized to tightly fit into cutout 265 by interference fit so that it will not come out easily. Plug 280 also defines the lower portion 230*b* of the wrench's through hole which is flush with the inside surface 286 defining the hole of the ring magnet 264. Inside surface 286 and through hole portion 230*b* are also in communication with the upper through hole portion 230*a* of the wheel and together define a through hole which is similar to through hole 30 of the first embodiment for receiving the insertable end 228 of socket 212. While similar, it will be appreciated that through hole portion or section 230*b* has a slightly larger inside diameter than that of through hole portion 230*b* and ring magnet 264. The larger inside diameter of through hole 230*a* is provided to expose the top surface 288 of the ring magnet so that it is capable of contacting and magnetically holding a ledge surface 290 of socket 212.

Figure 8:
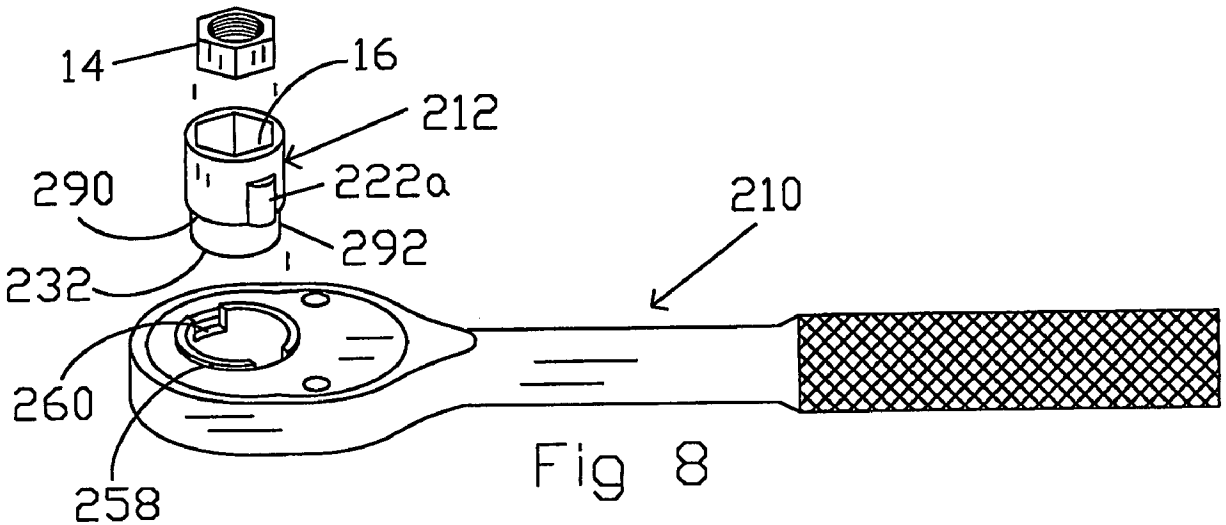
FIG. 8 is a partially exploded perspective view of another embodiment of the present invention showing the socket and ratchet wrench combination of FIG. 1 showing an exploded view of the nut, socket and wrench to illustrate the insertability of the socket in the wrench.
Figure 9:
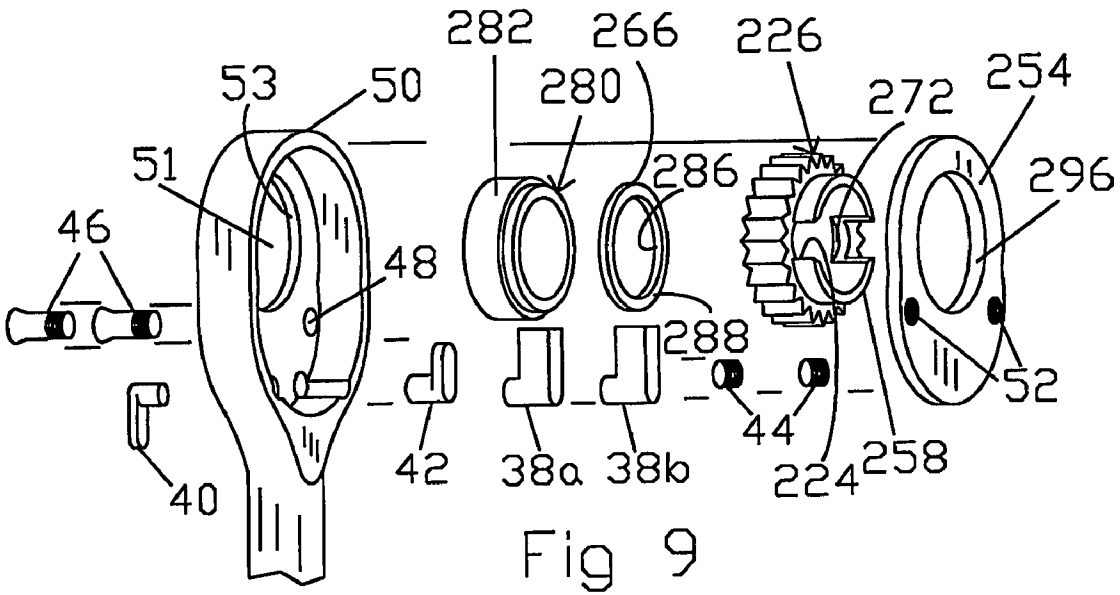
FIG. 9 is an exploded perspective view of the wrench of FIG. 8 showing the components of the wrench.
Figure 10:
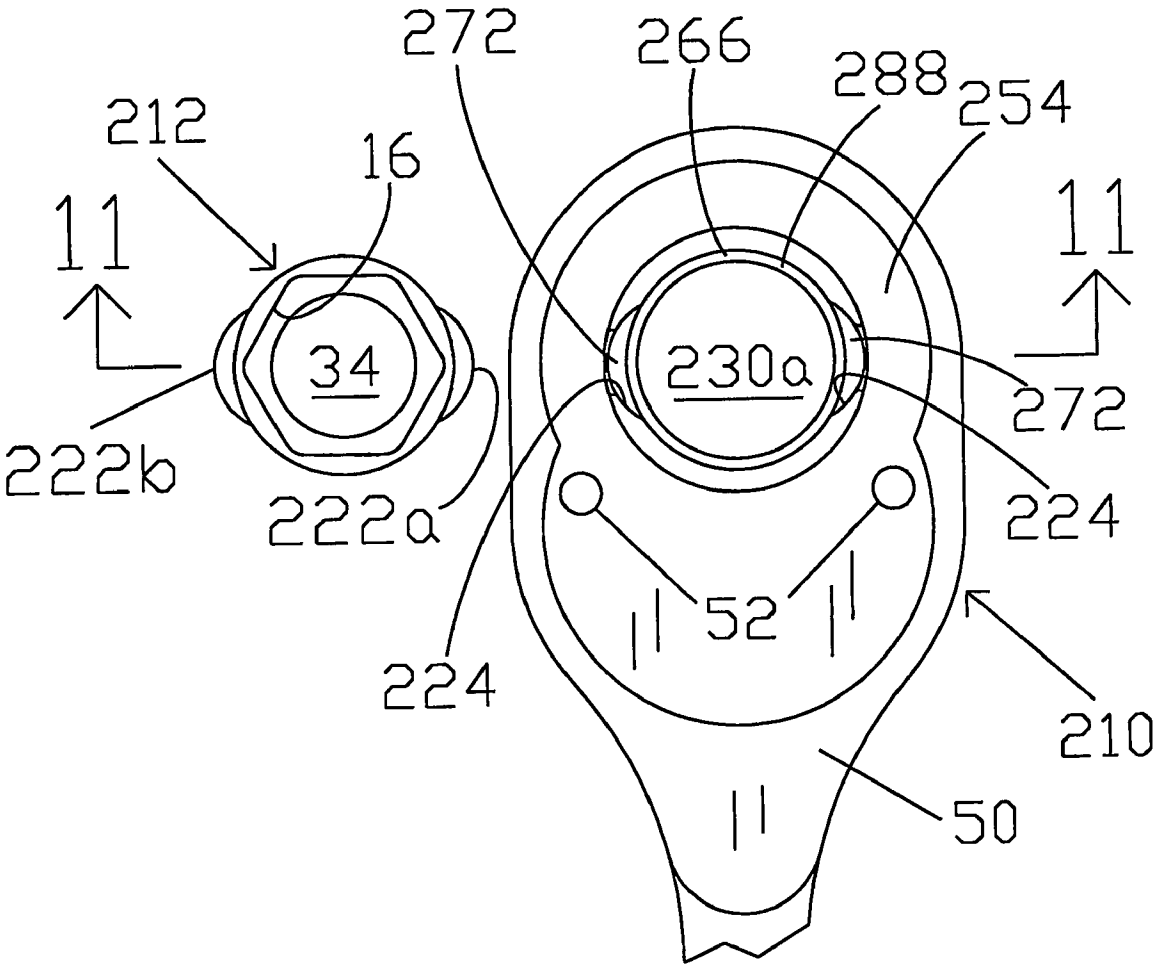
FIG. 10 is a top plan view showing separate top plan views of the wrench and socket of FIG. 8.

Turning now to socket 212, as shown in FIGS. 8 and 11 socket 212 is similar to socket 12 of the previous embodiment. However, instead of having just one cylindrical section as insertable end 28 of socket 12 has, insertable end 228 (which extends from lugs 22*a, b* to the bottom edge 232 of the socket) has two cylindrical sections 292, 294 of different outside diameters. As can be seen in FIGS. 8 and 11, the lower cylindrical section 292 has an outside diameter that is less than that of the upper section 294 of the socket's insertable end. These sections are connected by the aforementioned ledge surface 290 which makes contact with the top surface 288 of the ring magnet 264 when the socket is inserted in the wheel so that the magnet is capable of magnetically holding the socket in wheel 226. As also shown, the lower section 292 of the socket extends through and beyond the wheel and the exterior back side 274 of the flanged end 282 of the plug 280. As such, the socket's bottom edge 232 is located a short distance beyond or outwardly from back side 274 when the socket is securely received in aligned through holes 230*a, b*, as shown in FIG. 12 with ledge surface 290 in contact with and magnetically held by magnet 264. This length and positioning of the socket enables an individual to be able to easily remove the socket from the wrench by simply pushing against the socket's bottom edge 232 which will break the magnetic field when the socket is lifted slightly off the top surface 288 of magnet 264. Once the magnetic field is broken the socket can be simply grabbed and removed from through hole portions 230*a, b* or the wrench can be turned over to allow gravity to cause the socket to fall out of hole portion 230*a, b*. If bottom edge 232 of the socket is pushed hard enough the socket should actually pop out of aligned holes 230, *b* in a fashion similar to the way socket 12 pops out of wrench 10 of the previous embodiment which utilizes snap ring 64.

As best shown in FIG. 12, socket 212 is fully inserted in wheel 226 and in position to be driven with the wrench when lugs 222*a, b* are fully inserted in notches 224 with their bottom surfaces (not numbered) in contact with the bottom surfaces 272 of the notches. As previously mentioned, when fully inserted, ledge surface 290 of the socket will be in contact with the top surface 288 of magnet 264 and magnetically held thereby. It will also be appreciated that lugs 222*a, b* are similar to those of socket 12 of FIGS. 1-7. However, they are not provided with grooves 68 since this embodiment does not utilize a snap ring 64 to hold the socket in the wrench.

FIGS. 13 through 23 illustrate another embodiment of the present invention which includes a socket extension 310 in addition to the wrench 10 and socket 12 of FIGS. 1 through 6. Extension 310 has a generally elongate and cylindrical body 311 (shown in isolation in FIG. 23) which defines a through hole passageway 312 for receiving and allowing an externally threaded member such as bolt or threaded member 305 of FIG. 13 to pass through the extension.

Figure 13:
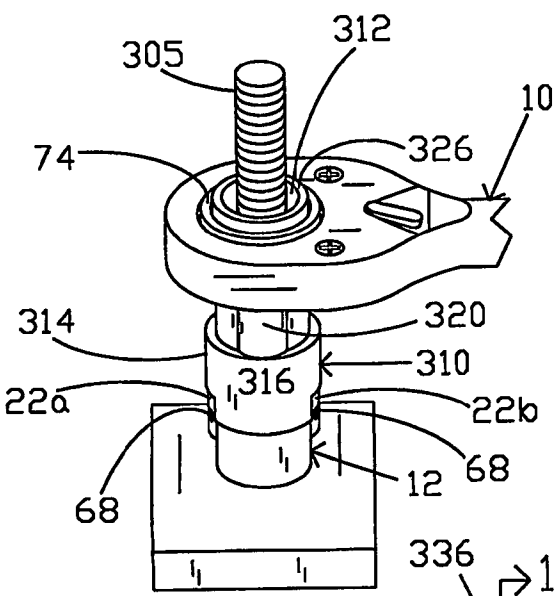
FIG. 13 is a perspective view of the socket and ratchet wrench combination of FIGS. 1 through 6 which additionally includes a socket extension for extending the reach of the socket. Also shown is the threaded shaft of a fastener being passed through the combination.

The extension body 311 also has a hollow cylindrical socket receiving end 314 which defines the entrance of through hole passageway 312 for engagingly receiving socket 12. To engagingly receive the socket, end 314 defines a pair of extension drive member receiving sections or notches 316 in the wall (not numbered) of end 314 for engagingly receiving the socket's drive members or lugs 22*a* and 22*b*. When engagingly received, the socket can be driven with the extension to drive a nut such as nut 14 shown in FIG. 14. In FIG. 13, the socket 12/extension 310/wrench 10 combination is driving nut 14 which while not visible in FIG. 13 will be appreciated as being threaded on bolt 305.

Figure 14:
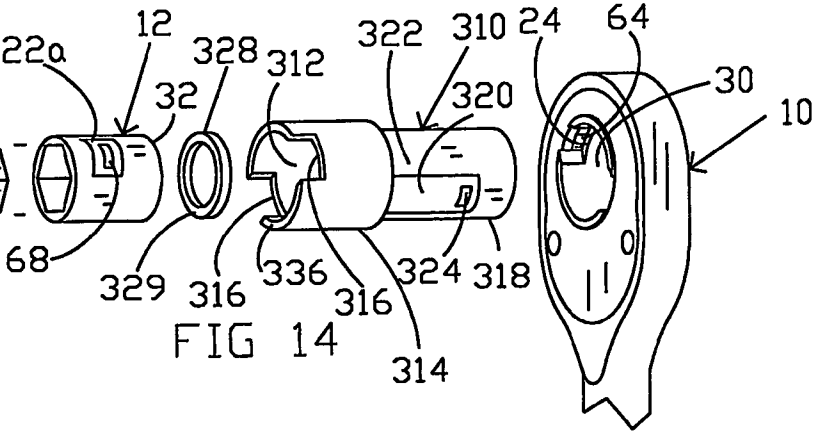
FIG. 14 is a partially exploded perspective view of the socket, extension and ratchet wrench combination of FIG. 13 showing an exploded view of the nut, socket, extension and wrench to illustrate the insertability of the extension in the wrench and the socket in the extension.
Figure 15:
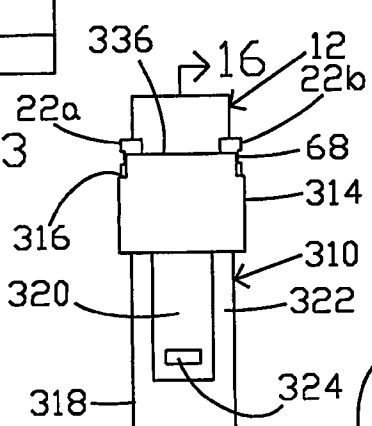
FIG. 15 is a side elevational view showing the socket and extension combination of FIG. 13.

As best shown in the exploded view of FIG. 13, it can be seen that the extension's body 311 also has a cylindrical insertable end 318 which is sized to fit closely in the through hole 30 of the wheel/gear. The close fitting reduces or limits wobbling of the extension in the wrench's through hole. In addition, FIG. 17 as well as FIGS. 14 and 15 illustrate that insertable end 318 is provided with a pair of extension drive members or lugs 320 which are located on the cylindrical exterior surface 322 of the insertable end. When the extension is fully inserted into the through hole of the wrench, lugs 320 will be engagingly received in the notches 24 of the wrench's wheel/gear, thereby enabling the extension to be driven with the wrench. As also shown, the extension's lugs 320 are each provided with a groove 324 for receiving the snap ring 64 of the wrench. Groove 324 as described above in connection with grooves 68 enables the extension to be releasably held by the snap ring when the socket is fully inserted in the through hole of the wrench's wheel/gear.

Extension 310 is also provided with a predetermined length so that when the extension is inserted in the wrench as shown in FIG. 13 the bottom edge 326 of the extension's insertable end extends beyond the back side 74 of the wrench's wheel/gear. This enables the bottom edge to be pushed by a user of the wrench (preferably with his thumb) to push it out of, i.e. release it, from the wrench's snap ring 64.

FIGS. 14, 16, 18 and 21 also illustrate that extension 310 is provided with a permanent ring magnet 328 (extension socket retention means) for releasably holding the socket in the extension when the socket's lugs are engagably received in the extension's notches 316. The ring magnet is mounted in the extension body 311 by being magnetically attracted to a ledge surface 330 of the extension's body which connects first and second sections 332, 334 of through hole passageway 312 (See FIG. 23). As also shown in FIG. 23, first section 332 has a larger inside diameter than that of second section 334 with the sections being connected by ledge surface 330 which as also shown and as indicated above is the surface upon which permanent magnet 328 is mounted by being magnetically attracted to the surface.

Figure 18:
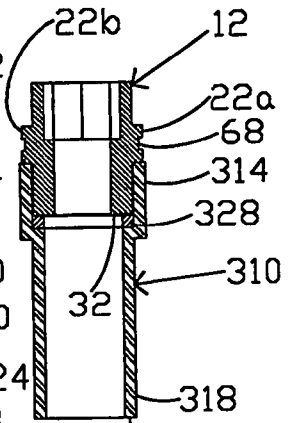
FIG. 18 is a cross sectional view taken along lines 18-18 of FIG. 17.
Figure 17:
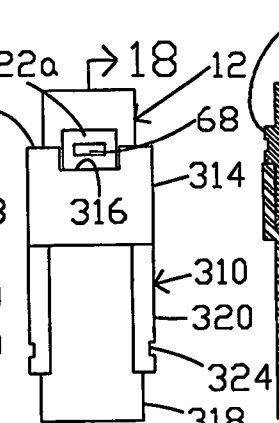
FIG. 17 is a another side elevational view of the socket and extension combination of FIG. 13 showing the combination as it appears after being rotated 90 degrees from its position in FIG. 15.
Figure 16:
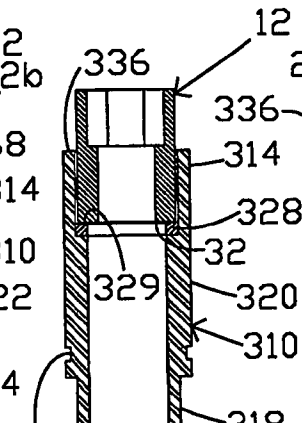
FIG. 16 is a cross sectional view taken along lines 16-16 of FIG. 15.

As shown in FIGS. 16 and 18, the ring magnet magnetically holds the socket in the extension body by magnetically attracting the socket's bottom edge 32 when the socket's lugs 22 are received in the extension's notches 316. The magnet is protected from being crushed or otherwise damaged by the socket when it is inserted in the extension body by providing the notch with a depth that cooperates with the lugs' height or position on the socket to prevent the socket from crushing the magnet. Preferably the notches' depth is such that when the socket's lugs are received in the notches the socket's bottom edge 32 just makes contact with the upper surface 329 of the magnet. If complete protection of the magnet is desired, the notches can be provided with a depth that leaves a small gap between the bottom edge of the socket and the top surface 329 of the magnet when the socket is inserted in the extension. As those skilled in the art will appreciate, the gap should not be so large as to prevent the magnet from magnetically attracting the socket's bottom edge. Preferably the gap is as small as technically possible which from a practical point of view would mean that the gap should be between about 3 and 7 thousandths of an inch.

As indicated above and as shown in the Figures, the socket receiving end 314 of the extension is essentially a hollow cylinder having a cylindrical wall (not numbered) of predetermined thickness which terminates at an end edge 336 of the wall. Notches 316 extend through the cylindrical wall and open into the end edge 336 of the wall. To facilitate removal of the socket from the extension which as indicated above is magnetically held in the extension by the ring magnet 328, the socket's lugs 22 may be provided with a predetermined thickness so that each lug extends slightly (and outwardly) beyond the outer surface (not numbered) of the cylindrical wall of the extension when the lugs are received in notches 316 of the extension. This slight predetermined extension or thickness of the lugs would facilitate removal of the socket from the extension by enabling one to easily grip or grasp the lugs and pull the socket out of the extension.

The socket's grooves 68 which are provided on each lug of the socket also facilitate removal of the socket from the extension since they provide surfaces which can be gripped in removing the socket from the extension. Additional grooves, knurls or other texturing could also be provided on the surface of the socket's lugs 22 to further enhance gripping of the socket. Indeed, it is believed that the socket's grooves should provide enough of a gripping surface to obviate the need for providing the socket's lugs with a thickness that extends them beyond the outer surface of the extension. This would be desirable since it would reduce the overall width of the socket, thereby making it easier to use the socket/extension combination in tight spaces. In view of the above, it will also be appreciated that the provision of the pair of opposing notches 316 in the cylindrical wall of end 314 is an important aspect of the present invention because it enables one to get a firm grip on a socket received in end 314 with ones thumb and a finger and thereby easily remove the socket from the extension.

Socket removal can also be enhanced by selecting a ring magnet 328 having magnetic strength which enables easy removal of the socket from the extension. However, the magnet should not be so weak as to allow the socket to easily fall out of the wrench. Accordingly, the ring magnet should have a strength which firmly holds the socket in the extension but which also enables the socket to be easily removed from the extension by grasping the lugs and pulling on them as discussed above. Neodymium magnets are the preferred type of magnet because of their high strength and the ability to easily vary the strength of the magnet by varying the thickness of the magnet. Neodymium magnets can also be ordered with different strengths.

While a ring magnet is the preferred means for holding the socket in the extension other means may also be utilized such as a snap ring, wire, flexible grommet, spring loaded ball/detent system, spring loaded switch or other differently shaped magnet(s).

The invention has been described in detail with reference to particular embodiments thereof, but it will be understood that various other modifications can be effected within the spirit and scope of this invention. For example, the inside diameter of the collars 58 and 258 of wrenches 10, 210 which actually define the mouth or entrance of the through holes of the wheels of these wrenches could be increased if it is deemed necessary to provide the sockets for these wrenches with a corresponding collar to strengthen the sockets in this area. Such a modification would also probably require an increase in the outside diameter of the collars 58, 258 as well as the use of a larger diameter snap ring on collar 58. The lugs of such sockets having this collar would be located on the collar similar to socket 212 described herein and the use of such collared sockets as well as the corresponding larger diameter collar on the wheel would enable the walls of the lower insertable ends of these collared sockets to be extremely thin which would be desirable since it would further increase the through hole capacity of the wrench.

In addition, while the disclosed embodiments use a permanent magnet or a snap ring as the means for retaining or holding the socket in the wrench other mechanisms such as a wire, flexible grommet, spring loaded ball/detent system and spring loaded switch (such as that employed in the through hole wrenches sold by Lowell Corp. of W. Boylston, Mass.) could also be used as the socket retention mechanism of the present invention and such use is considered to fall within the scope of the present invention as well as the use of any other socket retention means.

In addition, while the socket projections or lugs of the disclosed embodiments are provided on the socket and the notches are provided in the wheel's collar it, will be appreciated that the location of these members could be switched with the lugs projecting from the front side of the wheel and the notches provided in the wall of the socket.

We claim:

1. A socket and ratchet wrench combination comprising:

a wrench socket having a fastener receiving end defining a drive socket cavity for engagingly receiving a fastener to be driven and an insertable end defining a through hole passageway in communication with said drive socket cavity for receiving and allowing an externally threaded member to pass through said socket as the fastener is driven on the threaded member with a ratchet wrench, said socket also having a drive member on its exterior surface; and a ratchet wrench including:

a ratchet wheel/gear having a front side and a back side with a detented/toothed rim located between the wheel/gear's front side and back side, said wheel/gear also defining a through hole which is axially aligned about the rotational axis of said wheel/gear for receiving said insertable end of the wrench socket through the front side of said wheel/gear, said through hole extending through said ratchet wheel/gear from said front side thereof to and through said back side thereof to allow an externally threaded member to pass through said socket's through hole passageway as a fastener is driven on the threaded member with said ratchet wrench and socket, said ratchet wheel/gear further defining a drive member receiving section in said wheel/gear's front side for engagingly receiving said drive member of said socket to enable said socket to be driven with said wrench and wherein said through hole of said ratchet wheel/gear is a smooth surfaced cylindrically shaped hole;

a pawl, a wrench body receiving said ratchet wheel/gear for rotation relative to each other, said wrench body also receiving said pawl for (1) engaging said detented/toothed rim of said ratchet wheel/gear when said wrench body is rotated in a first direction relative to said ratchet wheel/gear to prevent said wrench body and said ratchet wheel/gear from rotating relative to each other and for (2) releasing said detented/toothed rim to permit said wrench body and said ratchet wheel/gear to rotate relative to each other when said wrench body is rotated in a second direction opposite the first direction; and socket retention means for releasably holding said socket in said ratchet wheel/gear when said socket's drive member is engagably received in said wheel/gear's drive member receiving section.

2. A socket and ratchet wrench combination as claimed in claim 1 wherein said drive member receiving section defined by said wheel/gear opens into said through hole on said front side of said wheel/gear.

3. A socket and ratchet wrench combination as claimed in claim 1 wherein said drive member is located on the mid-section of said exterior surface of said socket.

4. A socket and ratchet wrench combination as claimed in claim 1 wherein the section of said detented/toothed rim which engages said pawl is the force receiving section of said wheel/gear and the section of said drive member receiving section which engages said drive member to drive said socket is the offset force transmitting section of said wheel/gear and wherein said force receiving section is located along a first axial segment of said wheel/gear's axis of rotation and said offset force transmitting section is located along a second axial segment of said wheel/gear's axis of rotation and wherein said location of said second axial segment along said axis of rotation is different than that of said first axial segment.

5. A socket and ratchet wrench combination as claimed in claim 4 wherein said first axial segment overlaps said second axial segment.

6. A socket and ratchet wrench combination as claimed in claim 4 wherein the portion of said through hole of said wheel/gear located in said axial segment of said force receiving section of said wheel/gear is a cylindrically shaped hole.

7. A socket and ratchet wrench combination as claimed in claim 1 wherein said insertable end of said socket is sized to fit closely in said through hole of said wheel/gear to limit wobbling of the socket in the through hole.

8. A socket and ratchet wrench combination as claimed in claim 1 wherein said socket has a predetermined length so that when said socket is inserted in said wrench the bottom edge of said insertable end of said socket extends beyond said back side of said wheel/gear so that said bottom edge of said insertable end is capable of being pushed to facilitate the release of said socket by said socket retention means and removal of said socket from said wheel/gear.

9. A socket and ratchet wrench combination as claimed in claimed 1 wherein said socket retention means is provided by a member mounted in said wrench which is selected from the group of a snap ring, permanent magnet, wire, flexible grommet, spring loaded ball/detent system and spring loaded switch.

10. A socket and ratchet wrench combination as claimed in claimed 1 wherein said socket retention means includes a permanent magnet mounted in said wrench.

11. A socket and ratchet wrench combination as claimed in claimed 10 wherein said permanent magnet is mounted in said ratchet wheel/gear of said wrench.

12. A socket and ratchet wrench combination as claimed in claimed 11 wherein said permanent magnet(s) mounted in said ratchet wheel/gear magnetically attracts said socket to hold said first and second drive members together when said first and second drive members are engaging each other.

13. A socket and ratchet wrench combination as claimed in claimed 12 wherein said insertable end of said socket has two sections of different outside diameters and wherein the lower cylindrical section including the bottom edge of said insertable end of said socket has an outside diameter which is less than that of said other cylindrical section of said insertable end of said socket and wherein said cylindrical sections are connected by a ledge surface of said socket and wherein said permanent magnet is mounted in said wheel/gear so as to contact said ledge surface to magnetically hold said socket in said through hole of said wheel/gear when said when said first and second drive members are engaging each other.

14. A socket and ratchet wrench combination as claimed in claim 10 wherein said socket has a predetermined length so that when said socket is inserted in said wrench said bottom edge of said insertable end of said socket extends beyond said back side of said wheel/gear so that said insertable end is capable of being pushed to facilitate release of said socket by said permanent magnet and removal of said socket from said wheel/gear.

15. A socket and ratchet wrench combination as claimed in claimed 10 wherein said permanent magnet is a ring magnet.

16. A socket and ratchet wrench combination as claimed in claimed 1 wherein said socket retention means includes a snap ring.

17. A socket and ratchet wrench combination as claimed in claimed 16 wherein said snap ring is internally mounted on said ratchet wheel/gear.

18. A socket and ratchet wrench combination as claimed in claim 1 further comprising a socket extension defining a through hole passageway for receiving and allowing an externally threaded member to pass through said extension, said extension having a socket receiving end defining an extension drive member receiving section for engagingly receiving said drive member of said socket to enable said socket to be driven with said extension, said extension also having an insertable end and an extension drive member on the exterior surface of said insertable end for being engagingly received in said drive member receiving section of said wrench's wheel/gear to enable said extension to be driven with said wrench, said extension also including extension socket retention means for releasably holding said socket in said extension when said socket's drive member is engagably received in said extension drive member receiving section.

19. A socket and ratchet wrench combination as claimed in claim 18 wherein said insertable end of said extension is cylindrical and sized to fit closely in said through hole of said wheel/gear to limit wobbling of the extension in the through hole.

20. A socket and ratchet wrench combination as claimed in claim 18 wherein said extension has a predetermined length so that when said extension is inserted in said wrench the bottom edge of said insertable end of said extension extends beyond said back side of said wheel/gear so that said bottom edge of said insertable end can be pushed to facilitate the release of said extension by said socket retention means and removal of said extension from said wheel/gear.

21. A socket and ratchet wrench combination as claimed in claimed 18 wherein said extension socket retention means is provided by a member mounted in said extension which is selected from the group comprising a snap ring, permanent magnet, wire, flexible grommet, spring loaded ball/detent system and spring loaded switch.

22. A socket and ratchet wrench combination as claimed in claimed 18 wherein said extension socket retention means includes a permanent magnet mounted in said extension.

23. A socket and ratchet wrench combination as claimed in claimed 22 wherein said permanent magnet(s) mounted in said extension magnetically attracts said socket to hold said drive member of said socket in said extension drive member receiving section of said extension.

24. A socket and ratchet wrench combination as claimed in claimed 23 wherein said through hole passageway includes first and second sections having different inside diameters which are connected by a ledge surface and wherein a said permanent magnet is mounted in said extension at said ledge surface so as to magnetically hold said socket in said extension when said drive member of said socket is received in said extension drive member receiving section of said extension.

25. A socket and ratchet wrench combination as claimed in claimed 24 wherein said permanent magnet is a ring magnet which is mounted on said ledge surface of said extension.

26. A socket and ratchet wrench combination as claimed in claimed 18 wherein said extension drive member is provided with a groove for receiving a snap ring or other wire-like member of said wrench's socket retention means for releasably holding said extension in said through hole of said wrench's wheel/gear.

27. A socket and ratchet wrench combination as claimed in claimed 18 wherein said drive member of said socket has a surface for enhancing gripping of said socket to facilitate said socket's removal from said extension.

28. A socket and ratchet wrench combination as claimed in claimed 27 wherein said surface for enhancing gripping of said socket includes a groove.

29. A socket and ratchet wrench combination as claimed in claimed 18 wherein said drive member of said socket has a groove in its outer surface.

30. A socket and ratchet wrench combination comprising:

a wrench socket having a fastener receiving end defining a drive socket cavity for engagingly receiving a fastener to be driven and an insertable end defining a through hole passageway in communication with said drive socket cavity for receiving and allowing an externally threaded member to pass through said socket as the fastener is driven on the threaded member with a ratchet wrench, said socket also having a drive member on its exterior surface; and a ratchet wrench including:

a ratchet wheel/gear having a front side and a back side with a detented/toothed rim located between the wheel/gear's front side and back side, said wheel/gear also defining a through hole which is axially aligned about the rotational axis of said wheel/gear for receiving said insertable end of the wrench socket through the front side of said wheel/gear, said through hole extending through said ratchet wheel/gear from said front side thereof to and through said back side thereof to allow an externally threaded member to pass through said socket's through hole passageway as a fastener is driven on the threaded member with said ratchet wrench and socket, said ratchet wheel/gear further defining a drive member receiving section in said wheel/gear's front side for engagingly receiving said drive member of said socket to enable said socket to be driven with said wrench;

a pawl, a wrench body receiving said ratchet wheel/gear for rotation relative to each other, said wrench body also receiving said pawl for (1) engaging said detented/toothed rim of said ratchet wheel/gear when said wrench body is rotated in a first direction relative to said ratchet wheel/gear to prevent said wrench body and said ratchet wheel/gear from rotating relative to each other and for (2) releasing said detented/toothed rim to permit said wrench body and said ratchet wheel/gear to rotate relative to each other when said wrench body is rotated in a second direction opposite the first direction; and a snap ring internally mounted on said ratchet wheel/gear for releasably holding said socket in said ratchet wheel/gear when said socket's drive member is engagably received in said wheel/gear's drive member receiving section and wherein said insertable end of said socket and said through hole of said wheel are cylindrical and wherein said drive member is a lug projecting outwardly from the exterior surface of said socket and wherein said drive member receiving section is a notch which opens into said through hole on said front side of said wheel/gear and wherein said notch engagingly receives said lug to enable said socket to be driven and wherein said snap ring is axially mounted on said wheel/gear about said notch for releasably holding said socket in said ratchet wheel/gear by receiving and holding said lug of said socket when said socket is inserted in said through hole of said wheel/gear and said lug is engagingly received in said notch.

31. A socket and ratchet wrench combination as claimed in claimed 30 wherein said snap ring is internally mounted on said front side of said ratchet wheel/gear.

32. A socket and ratchet wrench combination as claimed in claimed 30 wherein said snap ring expands as it receives said lug and then contracts when it is received in a groove provided in said lug so as to releasably hold said socket in said through hole of said wheel/gear.

33. A socket and ratchet wrench combination as claimed in claimed 32 wherein said lug extends less than about 180 degrees around the circumference of said socket to facilitate passing of said lug through said snap ring.

34. A socket and ratchet wrench combination as claimed in claim 30 wherein a second lug is provided on said socket and wherein said first and second lugs are located 180 degrees apart from one another with each lug extending less than about 90 degrees around the circumference of said socket.

35. A socket and ratchet wrench combination as claimed in claim 34 wherein each lug extends less than about 60 degrees around the circumference of said socket.

36. A socket and ratchet wrench combination as claimed in claim 34 wherein each lug extends about 45 degrees or less around the circumference of said socket.

37. A socket and ratchet wrench combination as claimed in claim 34 wherein each lug extends about 15 degrees around the circumference of said socket.

38. A socket and ratchet wrench combination as claimed in claim 30 wherein the surfaces of said cylindrical insertable end of said socket and said cylindrical through hole of said wheel/gear are smooth to facilitate insertion of said socket in said through hole.

39. A socket and ratchet wrench combination comprising:

a wrench socket having a fastener receiving end defining a drive socket cavity for engagingly receiving a fastener to be driven and an insertable end defining a through hole passageway in communication with said drive socket cavity for receiving and allowing an externally threaded member to pass through said socket as the fastener is driven on the threaded member with a ratchet wrench, said socket also having a drive member on its exterior surface, said drive member extending a distance of X from the socket's axis of rotation; and a ratchet wrench including:

a ratchet wheel/gear having a front side and a back side with a detented/toothed rim located between the wheel/gear's front side and back side, said wheel/gear also defining a through hole which is axially aligned about the rotational axis of said wheel/gear for receiving said insertable end of the wrench socket through the front side of said wheel/gear, said through hole extending through said ratchet wheel/gear from said front side thereof to and through said back side thereof to allow an externally threaded member to pass through said socket's through hole passageway as a fastener is driven on the threaded member with said ratchet wrench and socket, said through hole having a maximum radius of Y as measured from the wheel/gear's axis of rotation wherein Y is less than X, said ratchet wheel/gear further defining a drive member receiving section in said wheel/gear's front side for engagingly receiving said drive member of said socket to enable said socket to be driven with said wrench;

a pawl, a wrench body receiving said ratchet wheel/gear for rotation relative to each other, said wrench body also receiving said pawl for (1) engaging said detented/toothed rim of said ratchet wheel/gear when said wrench body is rotated in a first direction relative to said ratchet wheel/gear to prevent said wrench body and said ratchet wheel/gear from rotating relative to each other and for (2) releasing said detented/toothed rim to permit said wrench body and said ratchet wheel/gear to rotate relative to each other when said wrench body is rotated in a second direction opposite the first direction; and socket retention means for releasably holding said socket in said ratchet wheel/gear when said socket's drive member is engagably received in said wheel/gear's drive member receiving section.

40. A socket and ratchet wrench combination as claimed in claim 39 wherein said drive member receiving section defined by said wheel/gear opens into said through hole on said front side of said wheel/gear.

41. A socket and ratchet wrench combination as claimed in claim 39 wherein said drive member is located on the mid-section of said exterior surface of said socket.

42. A socket and ratchet wrench combination as claimed in claim 39 wherein the section of said detented/toothed rim which engages said pawl is the force receiving section of said wheel/gear and the section of said drive member receiving section which engages said drive member to drive said socket is the offset force transmitting section of said wheel/gear and wherein said force receiving section is located along a first axial segment of said wheel/gear's axis of rotation with said offset force transmitting section being located along a second axial segment of said wheel/gear's axis of rotation and wherein said location of said second axial segment along the axis of rotation is different than that of said first axial segment.

43. A socket and ratchet wrench combination as claimed in claim 42 wherein said first axial segment overlaps said second axial segment.

44. A socket and ratchet wrench combination comprising:

a wrench socket having a fastener receiving end defining a drive socket cavity for engagingly receiving a fastener to be driven and a generally cylindrical insertable end defining a through hole passageway in communication with said drive socket cavity for receiving and allowing an externally threaded member to pass through said socket as the fastener is driven on the threaded member with a ratchet wrench, said socket also defining a first drive member on its exterior surface; and a ratchet wrench including:

a ratchet wheel/gear having a front side and a back side with a detented/toothed rim located therebetween, said wheel/gear also defining a generally cylindrical through hole which is axially aligned about the rotational axis of said wheel/gear for receiving said insertable end of the wrench socket through the front side of said wheel/gear, said through hole extending through said ratchet wheel/gear from said front side thereof to and through said back side thereof to allow an externally threaded member to pass through said socket's through hole passageway as a fastener is driven on the threaded member with said ratchet wrench and socket, said ratchet wheel/gear further defining a second drive member for engaging said first drive member of said socket to enable said socket to be driven with said wrench;

a pawl, a wrench body receiving said ratchet wheel/gear for rotation relative to each other, said wrench body also receiving said pawl for (1) engaging said detented/toothed rim of said ratchet wheel/gear when said wrench body is rotated in a first direction relative to said ratchet wheel/gear to prevent said wrench body and said ratchet wheel/gear from rotating relative to each other and for (2) releasing said detented/toothed rim to permit said wrench body and said ratchet wheel/gear to rotate relative to each other when said wrench body is rotated in a second direction opposite the first direction; and socket retention means for releasably holding said socket in said ratchet wheel/gear when said socket's first drive member is engaging said wheel/gear's second drive member.

45. A socket and ratchet wrench combination as claimed in claim 44 wherein said socket has a predetermined length so that when said socket is inserted in said wrench the bottom edge of said insertable end of said socket extends beyond said back side of said wheel/gear so that said bottom edge of said insertable end is capable of being pushed to facilitate release of said socket by said socket retention means and removal of said socket from said wheel/gear.

46. A socket and ratchet wrench combination as claimed in claim 44 wherein said second drive member receives said first drive member and wherein said second drive member opens into said through hole on said front side of said wheel/gear.

47. A socket and ratchet wrench combination as claimed in claimed 44 wherein said socket retention means includes a permanent magnet mounted in said wrench.

48. A socket and ratchet wrench combination as claimed in claimed 47 wherein said permanent magnet is mounted in said ratchet wheel/gear of said wrench.

49. A socket and ratchet wrench combination as claimed in claimed 48 wherein said permanent magnet(s) mounted in said ratchet wheel/gear magnetically attracts said socket to hold said first and second drive members together when said first and second drive members are engaging each other.

50. A socket and ratchet wrench combination as claimed in claimed 49 wherein said insertable end of said socket has two sections of different outside diameters and wherein the lower cylindrical section including the bottom edge of said insertable end of said socket has an outside diameter which is less than that of said other cylindrical section of said insertable end of said socket and wherein said cylindrical sections are connected by a ledge surface of said socket and wherein said permanent magnet is mounted in said wheel/gear so as to contact said ledge surface to magnetically hold said socket in said through hole of said wheel/gear when said when said first and second drive members are engaging each other.

51. A socket and ratchet wrench combination as claimed in claim 50 wherein said socket has a predetermined length so that when said socket is inserted in said wrench said bottom edge of said insertable end of said socket extends beyond said back side of said wheel/gear so that said insertable end is capable of being pushed to facilitate release of said socket by said permanent magnet and removal of said socket from said wheel/gear.

52. A socket and ratchet wrench combination as claimed in claimed 47 wherein said permanent magnet is a ring magnet.

53. A socket and ratchet wrench combination as claimed in claimed 44 wherein said socket retention means includes a snap ring.

54. A socket and ratchet wrench combination as claimed in claimed 53 wherein said snap ring is internally mounted on said ratchet wheel/gear.

55. A socket and ratchet wrench combination as claimed in claimed 54 wherein said first drive member is a lug projecting outwardly from the exterior surface of said socket and wherein said second drive member is a notch which opens into said through hole on said front side of said wheel/gear and wherein said notch engagingly receives said lug to drive said socket and wherein said snap ring is axially mounted on said wheel/gear about said notch for releasably holding said socket in said ratchet wheel/gear by receiving and holding said lug of said socket when said socket is inserted in said through hole of said wheel/gear and said lug is engagingly received in said notch.

56. A socket and ratchet wrench combination as claimed in claimed 55 wherein said snap ring is internally mounted on said front side of said ratchet wheel/gear.

57. A socket and ratchet wrench combination as claimed in claimed 55 wherein said snap ring expands as it receives said lug and then contracts when it is received in a groove provided in said lug so as to releasably hold said socket in said through hole of said wheel/gear.

58. A socket and ratchet wrench combination as claimed in claimed 57 wherein said lug extends less than about 180 degrees around the circumference of said socket to facilitate passing of said lug through said snap ring.

59. A socket and ratchet wrench combination as claimed in claim 55 wherein a second lug is provided on said socket and wherein said first and second lugs are located 180 degrees apart from one another with each lug extending less than about 90 degrees around the circumference of said socket.

60. A socket and ratchet wrench combination as claimed in claim 59 wherein each lug extends less than about 60 degrees around the circumference of said socket.

61. A socket and ratchet wrench combination as claimed in claim 59 wherein each lug extends about 45 degrees or less around the circumference of said socket.

62. A socket and ratchet wrench combination as claimed in claim 59 wherein each lug extends about 15 degrees around the circumference of said socket.

63. A socket and ratchet wrench combination as claimed in claimed 33 wherein said socket retention means is provided by a member mounted in said wrench which is selected from the group of a snap ring, permanent magnet, wire, flexible grommet, spring loaded ball/detent system and spring loaded switch.

64. A socket and ratchet wrench combination as claimed in claim 33 wherein said second drive member of said ratchet wheel/gear includes a drive projection and wherein said first drive member of said socket defines a notch for engagingly receiving said drive projection.

65. A socket and ratchet wrench combination as claimed in claim 33 wherein said cylindrical insertable end of said socket is sized to fit closely in said cylindrical through hole of said wheel/gear to limit wobbling of the socket in the through hole.

66. A socket and ratchet wrench combination as claimed in claim 65 wherein the surfaces of said cylindrical insertable end of said socket and said cylindrical through hole of said wheel/gear are smooth to facilitate insertion of said socket in said through hole.

67. A socket and ratchet wrench combination comprising:

a wrench socket having a fastener receiving end defining a drive socket cavity for engagingly receiving a fastener to be driven and a generally cylindrical insertable end defining a through hole passageway in communication with said drive socket cavity for receiving and allowing an externally threaded member to pass through said socket as the fastener is driven on the threaded member with a ratchet wrench, said socket also having a drive lug on its exterior surface; and a ratchet wrench including:

a ratchet wheel/gear having a front side and a back side with a detented/toothed rim located between the wheel/gear's front side and back side, said wheel/gear also defining a generally cylindrical through hole which is axially aligned about the rotational axis of said wheel/gear for receiving said insertable end of the wrench socket through the front side of said wheel/gear, said through hole extending through said ratchet wheel/gear from said front side thereof to and through said back side thereof to allow an externally threaded member to pass through said socket's through hole passageway as a fastener is driven on the threaded member with said ratchet wrench and socket, said ratchet wheel/gear further defining a notch for engagingly receiving said lug when said socket is inserted in said ratchet wheel/gear, said notch receiving and engaging said lug so that said socket can be driven with said wrench;

a pawl, a wrench body receiving said ratchet wheel/gear for rotation relative to each other, said wrench body also receiving said pawl for (1) engaging said detented/toothed rim of said ratchet wheel/gear when said wrench body is rotated in a first direction relative to said ratchet wheel/gear to prevent said wrench body and said ratchet wheel/gear from rotating relative to each other and for (2) releasing said detented/toothed rim to permit said wrench body and said ratchet wheel/gear to rotate relative to each other when said wrench body is rotated in a second direction opposite the first direction; and socket retention means for releasably holding said socket in said ratchet wheel/gear when said lug is received in said notch.

68. An improved socket and ratchet wrench combination of the type including a ratchet wrench having a body, a pawl and a ratchet wheel/gear having a detented/toothed rim located between the wheel/gear's front side and back side for engaging said pawl, said combination also of the type including a wrench socket for being received by said ratchet wrench to torque a fastener received in said wrench socket, wherein the improvement comprises:

a wrench socket having a fastener receiving end defining a drive socket cavity for engagingly receiving a fastener to be driven and a generally cylindrical insertable end defining a through hole passageway in communication with said drive socket cavity for receiving and allowing an externally threaded member to pass through said socket as the fastener is driven on the threaded member with a ratchet wrench, said socket also having a first drive lug on its exterior surface; and a ratchet wrench including a ratchet wheel/gear having a generally cylindrical through hole axially aligned about the rotational axis of said wheel/gear for receiving said insertable end of the wrench socket through the front side of said wheel/gear, said through hole extending through said ratchet wheel/gear from said front side thereof to and through said back side thereof to allow an externally threaded member to pass through said socket's through hole passageway as a fastener is driven on the threaded member with said ratchet wrench and socket, said ratchet wheel/gear further defining a notch in said wheel/gear's front side for engagingly receiving said first lug of said socket to enable said socket to be driven with said wrench; and a snap ring mounted on said ratchet wheel/gear for releasably holding said socket in said ratchet wheel/gear.

69. A socket and ratchet wrench combination as claimed in claimed 68 wherein said notch has a bottom which said lug impacts up against when said lug is engagingly received in said notch, said bottom of said notch preventing said socket from being pushed through said through hole of said wheel/gear.

70. A socket and ratchet wrench combination as claimed in claimed 69 wherein said front side of said wheel/gear defines a cylindrically shaped collar about said through hole which is axially aligned about said wheel/gear's axis of rotation and wherein said snap ring is mounted on the outer surface of said collar.

71. A socket and ratchet wrench combination as claimed in claimed 70 wherein said collar at least partially defines said notch for receiving said lug and wherein said snap ring is mounted about said notch so that when said lug is engagingly received in said notch a portion of said lug will be located between said snap ring and said bottom of said notch.

72. A socket and ratchet wrench combination as claimed in claimed 68 wherein said snap ring releasably holds said socket in said ratchet wheel/gear by receiving and holding said lug of said socket in said notch when said socket is inserted in said through hole of said wheel/gear and said lug is engagingly received in said notch.

73. A socket and ratchet wrench combination as claimed in claimed 68 wherein said snap ring expands as it receives said lug and then contracts when it is received in a groove provided in said lug so as to releasably hold said socket in said through hole of said wheel/gear.

74. A socket and ratchet wrench combination as claimed in claimed 73 wherein said lug extends less than about 180 degrees around the circumference of said socket to facilitate passing of said lug through said snap ring.

75. A socket and ratchet wrench combination as claimed in claim 73 wherein a second lug is provided on said socket and wherein said first and second lugs are located 180 degrees apart from one another with each lug extending less than about 90 degrees around the circumference of said socket.

76. A socket and ratchet wrench combination as claimed in claim 75 wherein each lug extends less than about 60 degrees around the circumference of said socket.

77. A socket and ratchet wrench combination as claimed in claim 75 wherein each lug extends about 45 degrees or less around the circumference of said socket.

78. A socket and ratchet wrench combination as claimed in claim 75 wherein each lug extends about 15 degrees around the circumference of said socket.

79. A socket and ratchet wrench combination as claimed in claimed 68 wherein said snap ring is internally mounted on said ratchet wheel/gear and axially aligned about said wheel/gear's axis of rotation.

80. A socket and ratchet wrench combination as claimed in claimed 68 wherein said snap ring is mounted on said front side of said wheel/gear and axially aligned about said wheel/gear's axis of rotation.

81. A socket and ratchet wrench combination as claimed in claim 68 wherein said socket has a predetermined length so that when said socket is inserted in said wrench the bottom edge of said insertable end of said socket projects beyond said back side of said wheel/gear so that said bottom edge of said socket is capable of being pushed to release said socket from said snap ring and thereby enable said socket to be removed from said wheel/gear.

82. A socket and ratchet wrench combination as claimed in claim 68 wherein said cylindrical insertable end of said socket is sized to fit closely in said cylindrical through hole of said wheel/gear to limit wobbling of the socket in the through hole.

83. A socket and ratchet wrench combination as claimed in claim 82 wherein the surfaces of said cylindrical insertable end of said socket and said cylindrical through hole of said wheel/gear are smooth to facilitate insertion of said socket in said through hole.

84. An improved socket and ratchet wrench combination of the type including a ratchet wrench having a body, a pawl and a ratchet wheel/gear having a detented/toothed rim located between the wheel/gear's front side and back side for engaging said pawl, said combination also of the type including a wrench socket for being received by said ratchet wrench to torque a fastener received in said wrench socket, wherein the improvement comprises:

a wrench socket having a fastener receiving end defining a drive socket cavity for engagingly receiving a fastener to be driven and a generally cylindrical insertable end defining a through hole passageway in communication with said drive socket cavity for receiving and allowing an externally threaded member to pass through said socket as the fastener is driven on the threaded member with a ratchet wrench, said socket also having a drive lug on its exterior surface; and a ratchet wrench including a ratchet wheel/gear having a generally cylindrical through hole axially aligned about the rotational axis of said wheel/gear for receiving said insertable end of the wrench socket through the front side of said wheel/gear, said through hole extending through said ratchet wheel/gear from said front side thereof to and through said back side thereof to allow an externally threaded member to pass through said socket's through hole passageway as a fastener is driven on the threaded member with said ratchet wrench and socket, said ratchet wheel/gear further defining a notch in said wheel/gear's front side for engagingly receiving said drive lug of said socket to enable said socket to be driven with said wrench; and socket retention means for releasably holding said socket in said ratchet wheel/gear when said drive lug is engagingly received in said notch, said socket further being provided with a predetermined length so that when said insertable end of said socket is inserted in said through hole of said wheel/gear and said drive lug is engagingly received in said notch, the bottom edge of said insertable end of said socket projects beyond said backside of said wheel/gear, said socket thereby being in a position where it can be released from said socket retention means by pushing against the bottom edge of the socket.

85. A wrench socket having a fastener receiving end defining a drive socket cavity for engagingly receiving a fastener to be driven and a cylindrical insertable end for being inserted in a ratchet wrench, said cylindrical insertable end defining a through hole passageway in communication with said drive socket cavity for receiving and allowing an externally threaded member to pass through said socket as the fastener is driven on the threaded member with a ratchet wrench, said socket also having a drive member on its exterior surface for being engaged by the ratchet wrench to drive said socket.

86. A socket as claimed in claim 85 wherein said drive member is located on the mid-section of said exterior surface of said socket.

87. A socket as claimed in claim 85 wherein said drive member is a first lug which extends less than 180 degrees around the circumference of said socket.

88. A socket as claimed in claim 87 wherein a second drive lug is provided on said socket and wherein said first and second drive lugs are located 180 degrees apart from one another with each lug extending less than about 90 degrees around the circumference of said socket.

89. A socket as claimed in claim 88 wherein each lug extends less than about 60 degrees around the circumference of said socket.

90. A socket as claimed in claim 88 wherein each lug extends about 45 degrees or less around the circumference of said socket.

91. A socket as claimed in claim 88 wherein each lug extends about 15 degrees around the circumference of said socket.

92. A socket as claimed in claim 85 wherein said socket has a predetermined length so that when said socket is inserted in the ratchet wrench the bottom edge of said insertable end of said socket projects through and beyond the back side of the ratchet wrench, thereby enabling said bottom edge of said socket to be pushed to facilitate removal of said socket from the ratchet wrench.

93. A socket as claimed in claim 85 wherein the outer surface of said cylindrical insertable end of said socket is smooth to facilitate insertion of said socket in said through hole.

94. A socket as claimed in claim 85 wherein said insertable end of said socket has an upper and lower cylindrical section with the lower cylindrical section having an outside diameter which is less than that of the upper section and wherein said drive member is located on the exterior surface of said upper section.

95. A socket set containing a plurality of differently sized wrench sockets for driving differently sized fasteners wherein each socket has a fastener receiving end defining a drive socket cavity for engagingly receiving a fastener to be driven and a cylindrical insertable end for being inserted in a ratchet wrench, said cylindrical insertable end defining a through hole passageway in communication with said drive socket cavity for receiving and allowing an externally threaded member to pass through said socket as the fastener is driven on the threaded member with a ratchet wrench, said socket also having a drive member on its exterior surface for being engaged by said ratchet wrench to drive said socket, and wherein all sockets of said set have an identical insertable end and drive member so that each socket may be inserted into and driven with a wrench that has been designed to receive the insertable end and drive member of said sockets.

96. A socket and ratchet wrench combination comprising:

a wrench socket having a fastener receiving end defining a drive socket cavity for engagingly receiving a fastener to be driven and an insertable end defining a through hole passageway in communication with said drive socket cavity for receiving and allowing an externally threaded member to pass through said socket as the fastener is driven on the threaded member with a ratchet wrench, said socket also having a drive member on its exterior surface; and a ratchet wrench including:

a ratchet wheel/gear having a front side and a back side with a detented/toothed rim located between the wheel/gear's front side and back side, said wheel/gear also defining a through hole which is axially aligned about the rotational axis of said wheel/gear for receiving said insertable end of the wrench socket through the front side of said wheel/gear, said through hole extending through said ratchet wheel/gear from said front side thereof to and through said back side thereof to allow an externally threaded member to pass through said socket's through hole passageway as a fastener is driven on the threaded member with said ratchet wrench and socket, said ratchet wheel/gear further defining a drive member receiving section in said wheel/gear's front side for engagingly receiving said drive member of said socket to enable said socket to be driven with said wrench;

a pawl, a wrench body receiving said ratchet wheel/gear for rotation relative to each other, aid wrench body also receiving said pawl for (1) engaging said detented/toothed rim of said ratchet wheel/gear when said wrench body is rotated in a first direction relative to said ratchet wheel/gear to prevent said wrench body and said ratchet wheel/gear from rotating relative to each other and for (2) releasing said detented/toothed rim to permit said wrench body and said ratchet wheel/gear to rotate relative to each other when said wrench body is rotated in a second direction opposite the first direction;

socket retention means for releasably holding said socket in said ratchet wheel/gear when said socket's drive member is engagably received in said wheel/gear's drive member receiving section; and, a socket extension defining a through hole passageway for receiving and allowing an externally threaded member to pass through said extension, said extension having a socket receiving end defining an extension drive member receiving section for engagingly receiving said drive member of said socket to enable said socket to be driven with said extension, said extension also having an insertable end and an extension drive member on the exterior surface of said insertable end for being engagingly received in said drive member receiving section of said wrench's wheel/gear to enable said extension to be driven with said wrench, said extension also including extension socket retention means for releasably holding said socket in said extension when said socket's drive member is engagably received in said extension drive member receiving section and wherein said drive member is a lug projecting outwardly from the exterior surface of said socket and wherein said extension drive member receiving section is a notch which opens into said through hole passageway of said extension and wherein said notch engagingly receives said lug to enable said socket to be driven.

97. A socket and ratchet wrench combination as claimed in claimed 96 wherein said socket receiving end of said extension is a hollow cylinder having a cylindrical wall of predetermined thickness which terminates at an end edge of said wall and wherein said notch extends through said cylindrical wall and opens into said end edge of said wall.

98. A socket and ratchet wrench combination as claimed in claimed 97 wherein said lug has a predetermined thickness so that it extends outwardly beyond the outer surface of said cylindrical wall when it is received in the notch provided in the cylindrical wall.

99. A socket and ratchet wrench combination as claimed in claimed 97 wherein said socket receiving end of said extension defines a pair of said notches in the cylindrical wall of said socket receiving end wherein said pair of notches oppose each other so as to enable said socket received in said socket receiving end of the extension to be gripped and removed from the extension.

100. A socket extension for use with a socket and ratchet wrench, said extension comprising:

an elongate body defining a through hole passageway for receiving and allowing an externally threaded member to pass through said extension, said extension body having a socket receiving end for engagingly receiving a socket and an insertable end for being engagingly received in a wrench to enable said extension to be driven with the wrench; and, a permanent magnet mounted in said extension body for magnetically holding said socket in said extension body when said socket is engagably received in said extension body and wherein said through hole passageway defined by said extension body includes first and second sections having different inside diameters which are connected by a ledge surface and wherein a said permanent magnet is mounted in said extension body at said ledge surface so as to magnetically hold said socket in said extension when said socket is received in said extension body.

101. A socket extension as claimed in claimed 100 wherein said permanent magnet is a ring magnet.

102. A socket extension for use with a socket and ratchet wrench, said extension comprising:

an elongate body defining a through hole passageway for receiving and allowing an externally threaded member to pass through said extension, said extension body having a hollow generally cylindrical socket receiving end wherein the cylindrical wall of said socket receiving end terminates at an end edge of said wall, said socket receiving end defining the entrance of said through hole passageway for engagingly receiving a socket having a drive member on the socket's exterior surface, said socket receiving end also defining a notch which extends through said cylindrical wall and opens into said end edge of said wall, said notch being sized and configured to engagingly receive the drive member of the socket to enable the socket to be driven with said extension, said extension body also having an insertable end for being engagingly received in a wrench to enable said extension to be driven with the wrench; and, socket retention means for releasably holding the socket in said extension when the socket's drive member is engagably received in said notch.

103. A socket extension as claimed in claim 102 wherein said insertable end of said extension includes a drive member on the exterior surface of said insertable end for being engagingly received in a wrench to enable said extension to be driven with the wrench.

104. A socket extension as claimed in claim 103 wherein said drive member of said extension is provided with a groove for receiving a snap ring or other wire-like member of said wrench for releasably holding said extension in the wrench.

105. A socket extension as claimed in claim 102 wherein said insertable end of said extension is generally cylindrical and sized to fit closely in a through hole of the wrench's wheel/gear to limit wobbling of the extension in the through hole.

106. A socket extension as claimed in claim 102 wherein said extension has a predetermined length so that when said extension is inserted in a wrench the bottom edge of said insertable end of said extension extends beyond said back side of the wrench so that said bottom edge of said insertable end can be pushed to facilitate the release of said extension by said socket retention means and removal of said extension from the wrench.

107. A socket extension as claimed in claim 102 wherein said socket retention means is provided by a member mounted in said extension which is selected from the group comprising a snap ring, permanent magnet, wire, flexible grommet, spring loaded ball/detent system and spring loaded switch.

108. A socket extension as claimed in claim 102 wherein said socket retention means includes a permanent magnet mounted in said extension.

109. A socket extension as claimed in claim 102 wherein said socket receiving end defines a pair of said notches in the cylindrical wall of said socket receiving end wherein said pair of notches oppose each other and wherein each notch extends through said cylindrical wall and opens into said end edge of said wall, said pair of opposing notches enabling a socket received in the socket receiving end of the extension to be gripped and removed from the extension.

110. A socket extension for use with a socket and ratchet wrench, said extension comprising:

an elongate body defining a through hole passageway for receiving and allowing an externally threaded member to pass through said extension, said extension body having a hollow generally cylindrical socket receiving end wherein the cylindrical wall of said socket receiving end terminates at an end edge of said wall, said socket receiving end defining the entrance of said through hole passageway for engagingly receiving a socket, said socket receiving end also defining a pair of opposing notches in the cylindrical wall of said socket receiving end wherein each extends through said cylindrical wall and opens into said end edge of said wall, said pair of opposing notches enabling a socket received in the socket receiving end of the extension to be gripped and removed from the extension; and, socket retention means for releasably holding the socket in said extension.

* * * * *